US010041710B2

(12) United States Patent
Morimoto et al.

(10) Patent No.: US 10,041,710 B2
(45) Date of Patent: Aug. 7, 2018

(54) HEAT EXCHANGER AND AIR CONDITIONER

(71) Applicant: DAIKIN INDUSTRIES, LTD., Osaka (JP)

(72) Inventors: Kousuke Morimoto, Osaka (JP); Yoshio Oritani, Osaka (JP); Masanori Jindou, Osaka (JP); Tomohiko Sakamaki, Osaka (JP); Takuya Kazusa, Osaka (JP); Junichi Hamadate, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 196 days.

(21) Appl. No.: 14/917,966

(22) PCT Filed: Sep. 5, 2014

(86) PCT No.: PCT/JP2014/004580
§ 371 (c)(1),
(2) Date: Mar. 10, 2016

(87) PCT Pub. No.: WO2015/037215
PCT Pub. Date: Mar. 19, 2015

(65) Prior Publication Data

US 2016/0223231 A1 Aug. 4, 2016

(30) Foreign Application Priority Data

Sep. 11, 2013 (JP) ..... 2013-188737

(51) Int. Cl.
*F25B 39/02* (2006.01)
*F28F 9/02* (2006.01)
(Continued)

(52) U.S. Cl.
CPC ..... *F25B 39/028* (2013.01); *F25B 13/00* (2013.01); *F25B 39/022* (2013.01);
(Continued)

(58) Field of Classification Search
CPC .. F25B 39/028; F25B 39/022; F28D 1/05383; F28D 1/05391; F28F 1/022; F28F 1/045;
(Continued)

(56) References Cited

U.S. PATENT DOCUMENTS

2009/0120627 A1* 5/2009 Beamer ..... F28D 1/05375 165/174
2010/0206535 A1 8/2010 Munoz et al.
(Continued)

FOREIGN PATENT DOCUMENTS

CN 102235781 A 11/2011
EP 2660549 A2 11/2013
(Continued)

OTHER PUBLICATIONS

International Search Report issued in corresponding application No. PCT/JP2014/004580 dated Dec. 9, 2014 (4 pages).
(Continued)

*Primary Examiner* — Joseph Trpisovsky
(74) *Attorney, Agent, or Firm* — Osha Liang LLP

(57) ABSTRACT

A heat exchanger includes a plurality of flat tubes arranged one above the other, a plurality of fins connected to the flat tubes, a first header collecting pipe in which one end of each of the plurality of flat tubes is inserted, and a second header collecting pipe in which the other end of each of the plurality of flat tubes is inserted. The heat exchanger exchanges heat between a fluid flowing through the flat tubes and air outside the flat tubes. Each of the first and second header collecting pipes extends in a vertical direction. At least one of the first and second header collecting pipes comprises a communi-
(Continued)

cation space that communicates with an upstream side of the plurality of flat tubes when the heat exchanger functions as an evaporator. The communication space comprises a partition plate.

20 Claims, 13 Drawing Sheets

(51) Int. Cl.

| | |
|---|---|
| ***F28F 27/02*** | (2006.01) |
| ***F28D 1/053*** | (2006.01) |
| ***F28F 1/02*** | (2006.01) |
| ***F28F 1/32*** | (2006.01) |
| ***F25B 13/00*** | (2006.01) |
| ***F28F 1/04*** | (2006.01) |

(52) U.S. Cl.
CPC ..... *F28D 1/05383* (2013.01); *F28D 1/05391* (2013.01); *F28F 1/022* (2013.01); *F28F 1/045* (2013.01); *F28F 1/325* (2013.01); *F28F 9/0204* (2013.01); *F28F 9/0265* (2013.01); *F28F 9/0278* (2013.01); *F28F 27/02* (2013.01); *F28F 2275/04* (2013.01)

(58) Field of Classification Search
CPC ..... F28F 1/325; F28F 9/0204; F28F 9/0265; F28F 9/0278; F28F 27/02; F28F 2275/04
USPC ..... 62/526, 524, 525
See application file for complete search history.

(56) References Cited

U.S. PATENT DOCUMENTS

| | | | |
|---|---|---|---|
| 2011/0253352 | A1 | 10/2011 | Suzuki et al. |
| 2011/0253353 | A1 | 10/2011 | Tokizaki et al. |
| 2011/0253354 | A1 | 10/2011 | Suzuki et al. |
| 2014/0338874 | A1 | 11/2014 | Jindou et al. |

FOREIGN PATENT DOCUMENTS

| | | | |
|---|---|---|---|
| JP | 2003343943 | A | 12/2003 |
| JP | 2010038448 | A | 2/2010 |
| JP | 2011242118 | A | 12/2011 |
| JP | 2013137193 | A | 7/2013 |

OTHER PUBLICATIONS

Written Opinion of the International Searching Authority issued in corresponding application No. PCT/JP2014/004580 dated Dec. 9, 2014 (4 pages).

Extended European Search Report issued in corresponding European Patent Application No. 14844405.2 dated Nov. 14, 2016 (7 pages).

Translation of the International Preliminary Report on Patentability dated Mar. 24, 2016 in corresponding International appication No. PCT/JP2014/004580 (8 pages).

* cited by examiner

HEAT EXCHANGER AND AIR CONDITIONER

TECHNICAL FIELD

Embodiments disclosed herein relate to a heat exchanger having flat tubes and fins for exchanging heat between a refrigerant and air, and an air conditioner.

BACKGROUND ART

Conventional heat exchangers have a plurality of flat tubes arranged one above the other, fins joined to the flat tubes, and two header collecting pipes each connected to one or the other end of the plurality of flat tubes, and are configured to exchange heat between a refrigerant and air (see, e.g., Patent Document 1 shown below).

In such a heat exchanger, a plurality of communication spaces, which communicate with associated ones of the plurality of flat tubes, are formed in each of the header collecting pipes. In this heat exchanger, the refrigerant which has flowed into the respective communication spaces is distributed into the plurality of flat tubes arranged one above the other in the communication space, and exchanges heat with the air while flowing through the respective flat tubes.

CITATION LIST

Patent Document

Patent Document 1: Japanese Unexamined Patent Publication No. 2013-137193

When such a heat exchanger functions as an evaporator, a gas-liquid two-phase refrigerant flows into the communication space, where the refrigerant is distributed into the plurality of flat tubes arranged one above the other. Here, the density of the liquid refrigerant is greater than the density of the gas refrigerant. Thus, if the refrigerant flows at a slow rate in the communication space, it is likely that the liquid refrigerant accumulates at the bottom of the communication space due to the gravity. Thus, when distributed into the respective flat tubes, the refrigerant flowing into upper flat tubes may have lesser wetness. This may cause the refrigerant flowing into the flat tubes in an upper portion of the heat exchanger, where the refrigerant with less wetness flows, to turn into a single-phase gas refrigerant in the middle of the flat tubes. The region where a superheated gas refrigerant flows hardly functions as an evaporator. Thus, the heat exchanger including such a region where a superheated gas refrigerant flows may possibly fail to exhibit sufficient performance.

To prevent the liquid refrigerant with greater density from accumulating in the bottom of the communication space, the following measures, for example, may be taken: a refrigerant inlet portion is provided at a lower portion of the communication space to form, in the communication space, a refrigerant flow path guiding the refrigerant upward from the lower portion; and the flat tubes are inserted deep inside the communication space to reduce the cross-sectional area of the refrigerant flow path and increase the flow rate of the refrigerant. However, in general, the header collecting pipes each have a circular cross section. Thus, even if the flat tubes are inserted deep inside, the cross-sectional area of the refrigerant flow path can only be reduced to a certain level, and the flow rate of the refrigerant cannot be sufficiently increased. Alternatively, the shape of the header collecting pipe may be changed to reduce the cross-sectional area of the refrigerant flow path. However, such a change requires a significant design modification in order to adjust the flow rate of the refrigerant to an optimum flow rate, which means that the flow rate of the refrigerant cannot be easily changed.

SUMMARY OF THE INVENTION

Embodiments disclosed herein are directed to a heat exchanger having a plurality of flat tubes arranged one above the other, and an air conditioner having such a heat exchanger, which may reduce variations in the wetness of the refrigerant flowing into the respective flat tubes, using a simple structure, and thereby allowing the heat exchanger to improve performance.

One or more embodiments of the invention are directed to a heat exchanger, including: a plurality of flat tubes arranged one above the other; fins connected to the flat tubes; a first header collecting pipe in which one end of each of the plurality of flat tubes is inserted; and a second header collecting pipe in which the other end of each of the plurality of flat tubes is inserted, and the heat exchanger is configured to exchange heat between a fluid flowing in the flat tubes and air outside the flat tubes. At least one of the first and second header collecting pipes extends in a vertical direction, and includes at least an upstream communication space in communication with an upstream side of the plurality of flat tubes when the heat exchanger functions as an evaporator. The heat exchanger further comprises a partition plate disposed in the upstream communication space. The partition plate extends in the vertical direction and divides the upstream communication space into a first space in communication with the plurality of flat tubes and a second space in communication with an inlet portion configured to introduce a refrigerant into the upstream communication space when the heat exchanger functions as an evaporator. A communication path, which is located at a lower portion of the upstream communication path, allows the first space and the second space to communicate with each other.

According to one or more embodiments, the upstream communication space in communication with the upstream side of the plurality of flat tubes when the heat exchanger functions as an evaporator comprises the partition plate that extends in the vertical direction and divides the upstream communication space into the first space in communication with the plurality of flat tubes, and a second space in communication with the inlet portion for introducing the refrigerant when the heat exchanger functions as an evaporator. Further, the communication path allowing the first space and the second space to communicate with each other is formed at a lower portion of the upstream communication space. In this structure, when the heat exchanger functions as an evaporator, the gas-liquid two-phase refrigerant flowing into the upstream communication space is introduced first to the second space), and then flows to a lower portion of the first space through the communication path. The refrigerant is distributed to the plurality of flat tubes in communication with the first space, while flowing upward in the first space.

In one or more embodiments, the partition plate provided in the upstream communication space significantly reduces the cross-sectional area of the flow path of the refrigerant flowing from the lower portion to the upper portion of the upstream communication space when the heat exchanger functions as an evaporator. The flow rate of the refrigerant therefore significantly increases, compared to the case without the partition plate. Thus, the liquid refrigerant, with greater density, of the gas-liquid two-phase refrigerant which has flowed into the first space does not accumulate in the bottom of the first space, but is blown up fast against gravity together with the gas refrigerant. Consequently, the gas-liquid two-phase refrigerant in the state of mixture of the liquid and gas refrigerants flows into the respective flat tubes in communication with the first space. In other words, the partition plate, which increases the flow rate of the refrigerant, reduces variations in the wetness of the refrigerant flowing into the respective flat tubes from the upstream communication space.

Further, in one or more embodiments, the cross-sectional area of the first space is changed by changing the location of the partition plate in the upstream communication space. This change in the cross-sectional area of the first space changes the flow rate of the refrigerant flowing in a lower portion to an upper portion of the first space. In other words, the flow rate of the refrigerant flowing from the lower portion to the upper portion of the first space is easily changed by simply changing the location of the partition plate in the upstream communication space.

In one or more embodiments, the communication path is located below the lowermost one of the flat tubes that are in communication with the upstream communication space.

According to one or more embodiments, the communication path is located below the lowermost one of the plurality of flat tubes in communication with the upstream communication space. Thus, the communication path does not face any one of the open end faces of the flat tubes. Thus, the refrigerant flowing into the first space from the second space is not blown directly on a specific flat tube, and is uniformly distributed to the respective flat tubes in communication with the first space.

In one or more embodiments, the communication path is a through hole formed in a lower portion of the partition plate.

According to one or more embodiments, the refrigerant introduced to the second space flows into a lower portion of the first space through the through hole formed in a lower portion of the partition plate.

In one or more embodiments, a division plate, is located in a lower portion of the upstream communication space above the inlet portion of the communication path, that divides the second space into an upper space and a lower space.

According to one or more embodiments, the division plate divides the second space into the lower space, to which the refrigerant is introduced when the heat exchanger functions as an evaporator, and the upper space above the lower space. The refrigerant introduced to the lower space of the second space is not blown up, but flows to a lower portion of the first space through the communication path.

In one or more embodiments, the partition plate comprises a communication hole allowing the upper space of the second space and the first space to communicate with each other.

In one or more embodiments, if the second space is divided into upper and lower spaces by the division plate located above the inlet portion and the communication path, the upper space of the second space above the division plate will be a closed space that does not communicate with either of the lower space below the division plate or the first space. Thus, the internal pressure of the upper space of the second space is not changed even when the refrigerant is introduced to the heat exchanger, and remains at atmospheric pressure, which is a pressure when the heat exchanger was assembled. On the other hand, the internal pressure of the lower space of the second space and the internal pressure of the first space are higher, in general, than atmospheric pressure, since the refrigerant is introduced to the lower space and the first space when the heat exchanger functions as a condenser or an evaporator. In other words, when the heat exchanger functions as a condenser or an evaporator, the refrigerant flows into the lower space of the second space and into the first space, and the internal pressures of the lower space and the first space become approximately equal to each other, whereas the upper space of the second space is a closed space that does not communicate with the first space and the lower space of the second space. This generates a difference in the internal pressure between the upper space, and the first space and the lower space of the second space. This difference in the internal pressure between the upper space of the second space, and the first space and the lower space of the second space may cause, for example, a deformation in the header collecting pipe, the partition plate, and the division plate, if the stiffness of the header collecting pipe, the partition plate, and the division plate is low.

To avoid this, according to one or more embodiments, the partition plate comprises the communication hole allowing the first space and the upper space of the second space to communicate with each other. Thus, even if the internal pressure of the first space and the internal pressure of the lower space of the second space become higher than the internal pressure of the upper space of the second space when the heat exchanger functions as a condenser or an evaporator, the refrigerant in the first space flows into the upper space of the second space through the communication hole, thereby equalizing the internal pressures of the first space and the upper space.

One or more embodiments of the invention are directed to an air conditioner, that includes a refrigerant circuit provided with the heat exchanger, wherein a refrigerant is circulated in the refrigerant circuit to perform a refrigeration cycle.

According to one or more embodiments, the heat exchanger is connected to the refrigerant circuit. In the heat exchanger, the refrigerant circulating in the refrigerant circuit exchanges heat with the air while flowing in the flat tubes.

According to one or more embodiments, the cross-sectional area of the flow path of the refrigerant flowing from a lower portion to an upper portion of the upstream communication space can be significantly reduced by simply providing, in the upstream communication space communicating with the upstream side of the plurality of flat tubes when the heat exchanger functions as an evaporator, the partition plate which divides the upstream communication space into the first space closer to the flat tube and the second space closer to the inlet portion. This allows for significantly increasing the flow rate of the refrigerant flowing from the lower portion to the upper portion of the upstream communication space, compared to the case without partition plate. In other words, the liquid refrigerant, with greater density, of the gas-liquid two-phase refrigerant which has flowed into the first space does not accumulate in the bottom of the first space, but is blown up fast against gravity together with the gas refrigerant. Consequently, the gas-liquid two-phase refrigerant in the state of mixture of the liquid and gas refrigerants flows into the respective flat tubes in communication with the first space. Thus, according to one or more embodiments, variations in the wetness of the refrigerant flowing into the flat tubes can be reduced by a simple structure, thereby allowing the heat exchanger to exhibit sufficient performance.

Further, according to one or more embodiments, the flow rate of the refrigerant flowing from the lower portion to the upper portion of the first space can be easily changed by simply changing the location of the partition plate in the upstream communication space. Thus, the flow rate of the refrigerant flowing from the lower portion to the upper portion of the upstream communication space can be adjusted to an appropriate rate by simply changing the location of the partition plate in the upstream communication space without complicated design modifications.

In one or more embodiments, the communication path is formed below the lowermost one of the plurality of flat tubes in communication with the upstream communication space. In this structure, the communication path does not face any one of the open end faces of the flat tubes. Thus, the refrigerant flowing into the first space from the second space is not blown directly on a specific flat tube. Accordingly, the refrigerant which has flowed into the first space from the second space can be uniformly distributed to the respective flat tubes in communication with the first space.

Further, in one or more embodiments, the communication path which connects the first space and the second space can be easily formed by utilizing the through hole formed at a lower portion of the partition plate.

Further, in one or more embodiments, the second space comprises the division plate, which divides the second space into the lower space to which the refrigerant is introduced when the heat exchanger functions as an evaporator, and the upper space located above the lower space. In this structure, the lower space as an inlet space to which the refrigerant is introduced when the heat exchanger functions as an evaporator, is a small space. This structure allows for limiting a flow rate reduction of the refrigerant in the second space to a lesser degree. Thus, the gas-liquid two-phase refrigerant can be blown up fast in the first space.

Further, in one or more embodiments, the partition plate comprises the communication hole allowing the first space and the upper space of the second space to communicate with each other. This structure equalizes the internal pressure of the first space and the internal pressure of the upper space of the second space when the heat exchanger to which the refrigerant has been introduced functions as a condenser or an evaporator. Thus, the deformation or other damage to the header collecting pipe, the partition plate, and the division plate can be prevented without increasing the stiffness of these members.

DESCRIPTION OF EMBODIMENTS

Embodiments of the present invention will now be described in detail, based on the drawings. The following embodiments are merely examples in nature, and are not intended to limit the scope, applications, and use of the invention.

<<First Aspect of the Invention>>

Embodiments of a first aspect of the present invention will be described below. The heat exchanger according to one or more embodiments is an outdoor heat exchanger (23) provided in an air conditioner (10). In the following description, the air conditioner (10) will be described first, and then the outdoor heat exchanger (23) will be described in detail.

—Air Conditioner—

Figure 1:
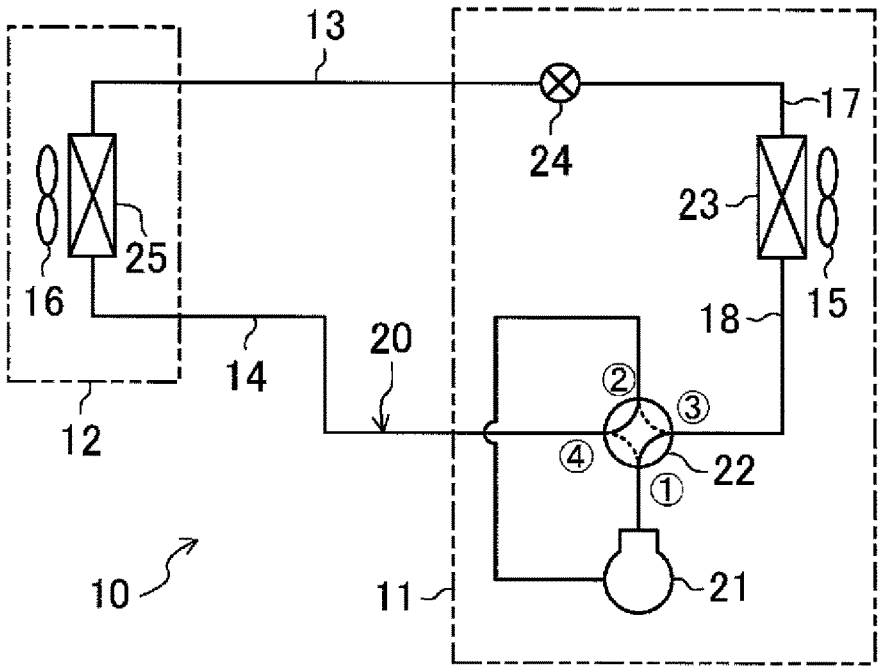
FIG. 1 shows a refrigerant circuit for generally illustrating a configuration of an air conditioner having an outdoor heat exchanger according to one or more embodiments.

An air conditioner (10) will be described with reference to FIG. 1.

<Configuration of Air Conditioner>

The air conditioner (10) includes an outdoor unit (11) and an indoor unit (12). The outdoor unit (11) and the indoor unit (12) are connected to each other through a liquid communication pipe (13) and a gas communication pipe (14). In this air conditioner (10), the outdoor unit (11), the indoor unit (12), the liquid communication pipe (13), and the gas communication pipe (14) form a refrigerant circuit (20).

The refrigerant circuit (20) comprises a compressor (21), a four-way switching valve (22), an outdoor heat exchanger (23), an expansion valve (24), and an indoor heat exchanger (25). The compressor (21), the four-way switching valve (22), the outdoor heat exchanger (23), and the expansion valve (24) are housed in the outdoor unit (11). The outdoor unit (11) comprises an outdoor fan (15) for supplying outdoor air into the outdoor heat exchanger (23). The indoor heat exchanger (25) is housed in the indoor unit (12). The indoor unit (12) comprises an indoor fan (16) for supplying room air to the indoor heat exchanger (25).

The refrigerant circuit (20) is a closed circuit filled with a refrigerant. In the refrigerant circuit (20), a discharge pipe of the compressor (21) is connected to a first port of the four-way switching valve (22), and a suction pipe thereof is connected to a second port of the four-way switching valve (22). Further, in the refrigerant circuit (20), the outdoor heat exchanger (23), the expansion valve (24), and the indoor heat exchanger (25) are arranged sequentially from a third port to a fourth port of the four-way switching valve (22). In the refrigerant circuit (20), the outdoor heat exchanger (23) is connected to the expansion valve (24) through a pipe (17), and is connected to the third port of the four-way switching valve (22) through a pipe (18).

The compressor (21) is a hermetic scroll compressor or a rotary compressor. The four-way switching valve (22) switches between a first state (the state indicated by solid line in FIG. 1) in which the first port and the third port communicate with each other and the second port and the fourth port communicate with each other, and a second state (the state indicated by broken line in FIG. 1) in which the first port and the fourth port communicate with each other and the second port and the third port communicate with each other. The expansion valve (24) is an electronic expansion valve.

The outdoor heat exchanger (23) exchanges heat between outdoor air and the refrigerant. The outdoor heat exchanger (23) will be described later. The indoor heat exchanger (25), on the other hand, exchanges heat between room air and the refrigerant. The indoor heat exchanger (25) is implemented as a cross-fin-and-tube heat exchanger having a heat transfer pipe which is a circular pipe.

<Operation of Air Conditioner>

The air conditioner (10) selectively performs a cooling operation and a heating operation.

During the cooling operation, the refrigerant circuit (20) performs a refrigeration cycle with the four-way switching valve (22) set to the first state. In this state, the refrigerant flows sequentially through the outdoor heat exchanger (23), the expansion valve (24), and the indoor heat exchanger (25). The outdoor heat exchanger (23) functions as a condenser, and the indoor heat exchanger (25) functions as an evaporator. In the outdoor heat exchanger (23), the gas refrigerant which has flowed into the outdoor heat exchanger (23) from the compressor (21) dissipates heat to the outdoor air, and is condensed. The condensed refrigerant flows out from the outdoor heat exchanger (23) to the expansion valve (24).

During the heating operation, the refrigerant circuit (20) performs a refrigeration cycle with the four-way switching valve (22) set to the second state. In this state, the refrigerant sequentially flows through the indoor heat exchanger (25), the expansion valve (24), and the outdoor heat exchanger (23). The indoor heat exchanger (25) functions as a condenser, and the outdoor heat exchanger (23) functions as an evaporator. The refrigerant which has expanded while passing through the expansion valve (24) and turned to be a gas-liquid two-phase refrigerant flows into the outdoor heat exchanger (23). The refrigerant which has flowed into the outdoor heat exchanger (23) absorbs heat from the outdoor air and evaporates, and thereafter flows out from the outdoor heat exchanger (23) to the compressor (21).

—Outdoor Heat Exchanger—

The outdoor heat exchanger (23) will now be described with reference to FIGS. 2-10 as needed. Note that the number of flat tubes (31) mentioned in the following description is merely an example.

Figure 2:
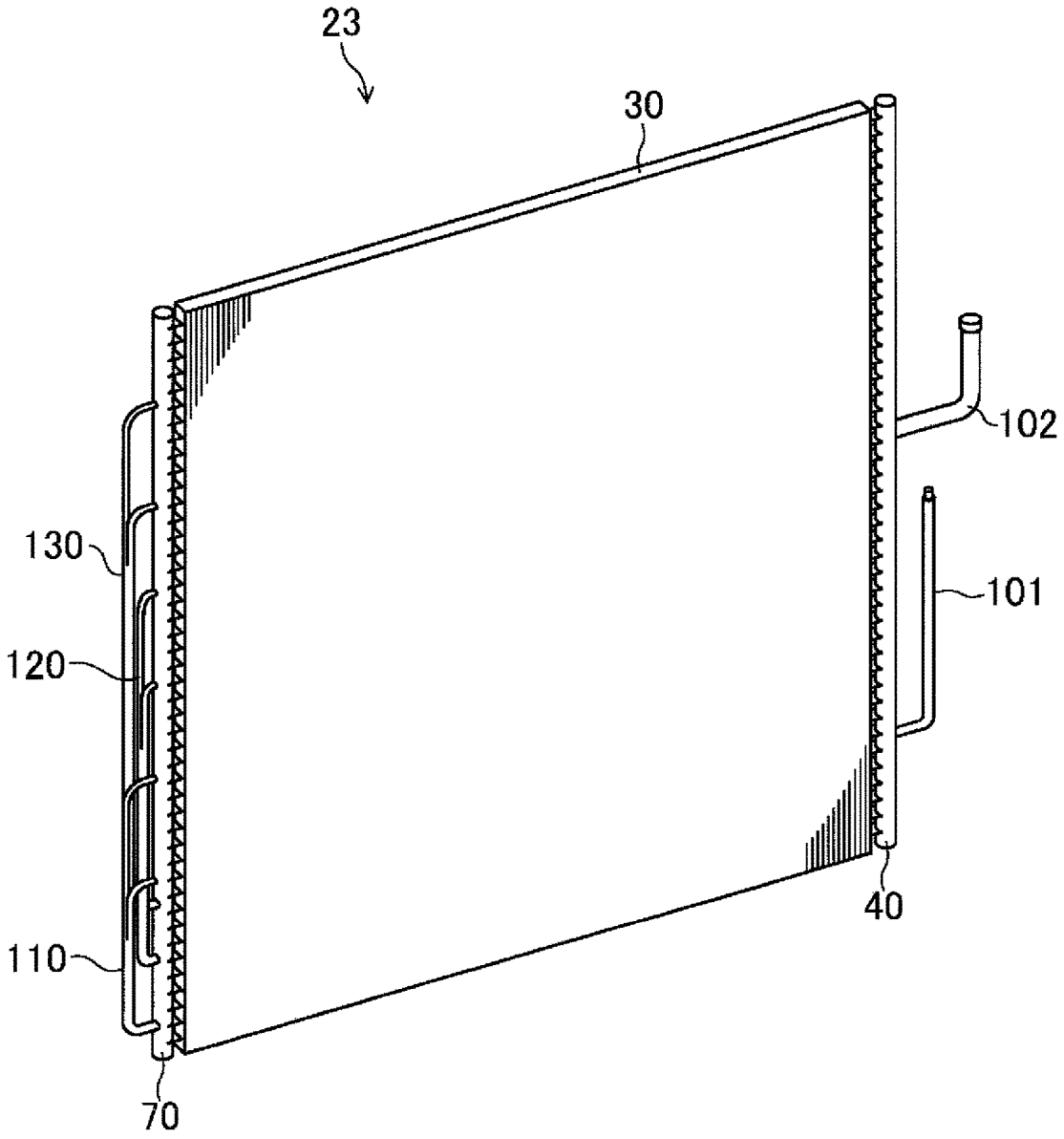
FIG. 2 generally illustrates a perspective view of the configuration of the outdoor heat exchanger according to one or more embodiments.

As illustrated in FIG. 2, the outdoor heat exchanger (23) is an air heat exchanger, and includes one heat exchanger unit (30).

Figure 3:
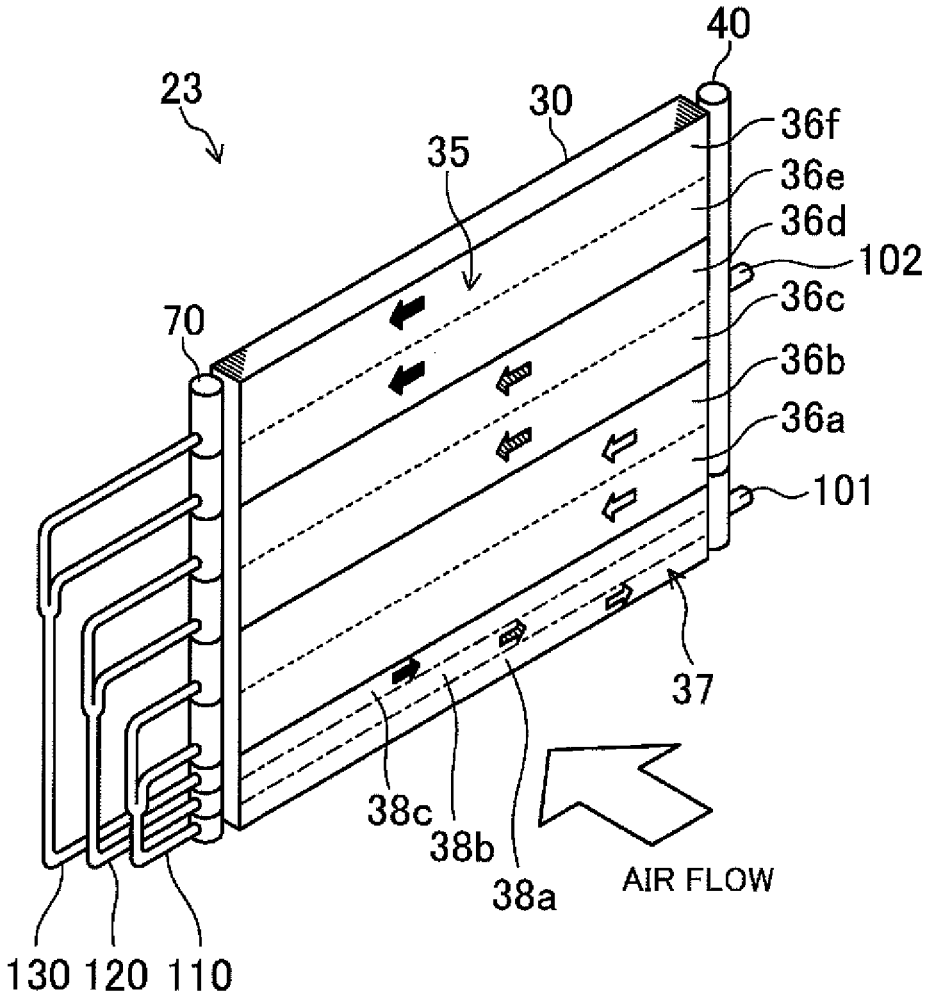
FIG. 3 generally illustrates a perspective view of a heat exchanger unit according to one or more embodiments, and shows the refrigerant flow when the outdoor heat exchanger functions as a condenser.
Figure 5:
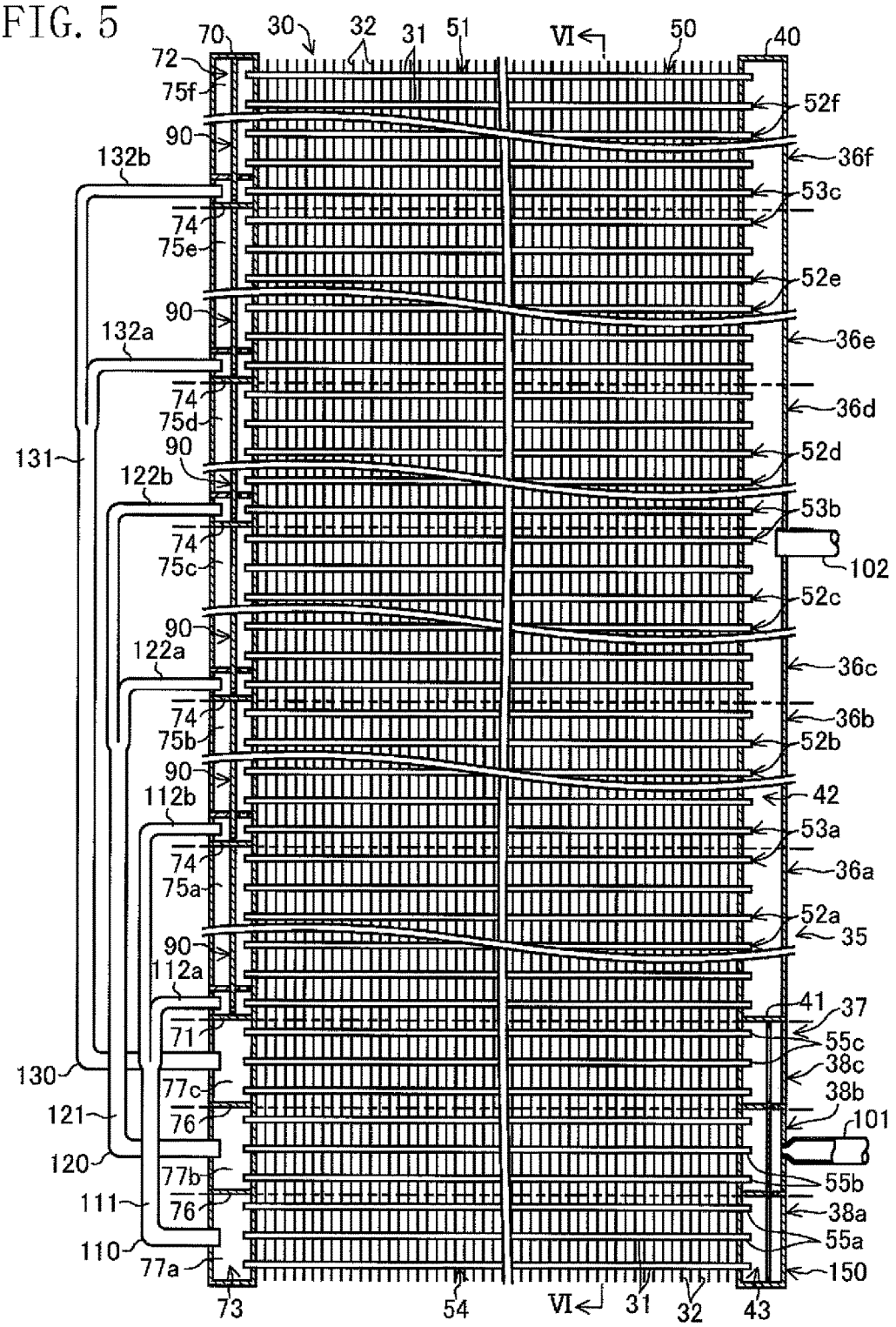
FIG. 5 illustrates a partial cross-sectional view of the heat exchanger unit according to one or more embodiments viewed from the front.

As is also illustrated in FIGS. 3 and 5, the heat exchanger unit (30) has one first header collecting pipe (40), one second header collecting pipe (70), a large number of flat tubes (31), and a large number of fins (32). All of the first header collecting pipe (40), the second header collecting pipe (70), the flat tubes (31), and the fins (32) are aluminum alloy members, and connected together by brazing.

As will be described in detail later, the heat exchanger unit (30) is divided into two upper and lower regions. In this heat exchanger unit (30), the upper region serves as a principal heat exchange region (35), and the lower region serves as an auxiliary heat exchange region (37).

The first header collecting pipe (40) and the second header collecting pipe (70) are each formed in an elongated cylindrical shape with both ends closed. In FIG. 5, the first header collecting pipe (40) is disposed upright at the right end of the heat exchanger unit (30), and the second header collecting pipe (70) is disposed upright at the left end of the heat exchanger unit (30). That is, each of the first header collecting pipe (40) and the second header collecting pipe (70) is disposed with its axis extending vertically.

Figure 6:
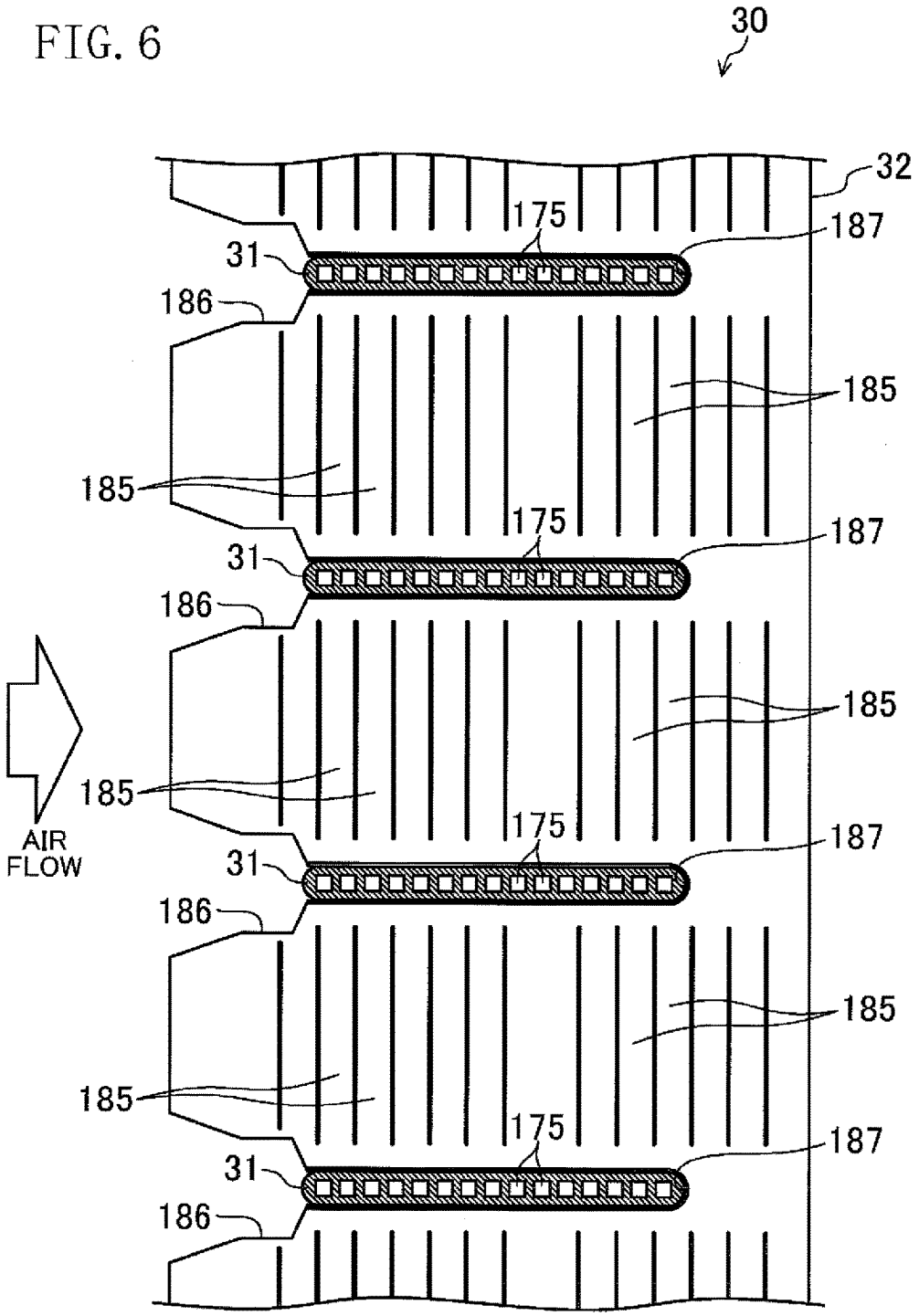
FIG. 6 illustrates a partially enlarged cross-sectional view of the heat exchanger unit taken along the plane VI-VI of FIG. 5.
Figure 7:
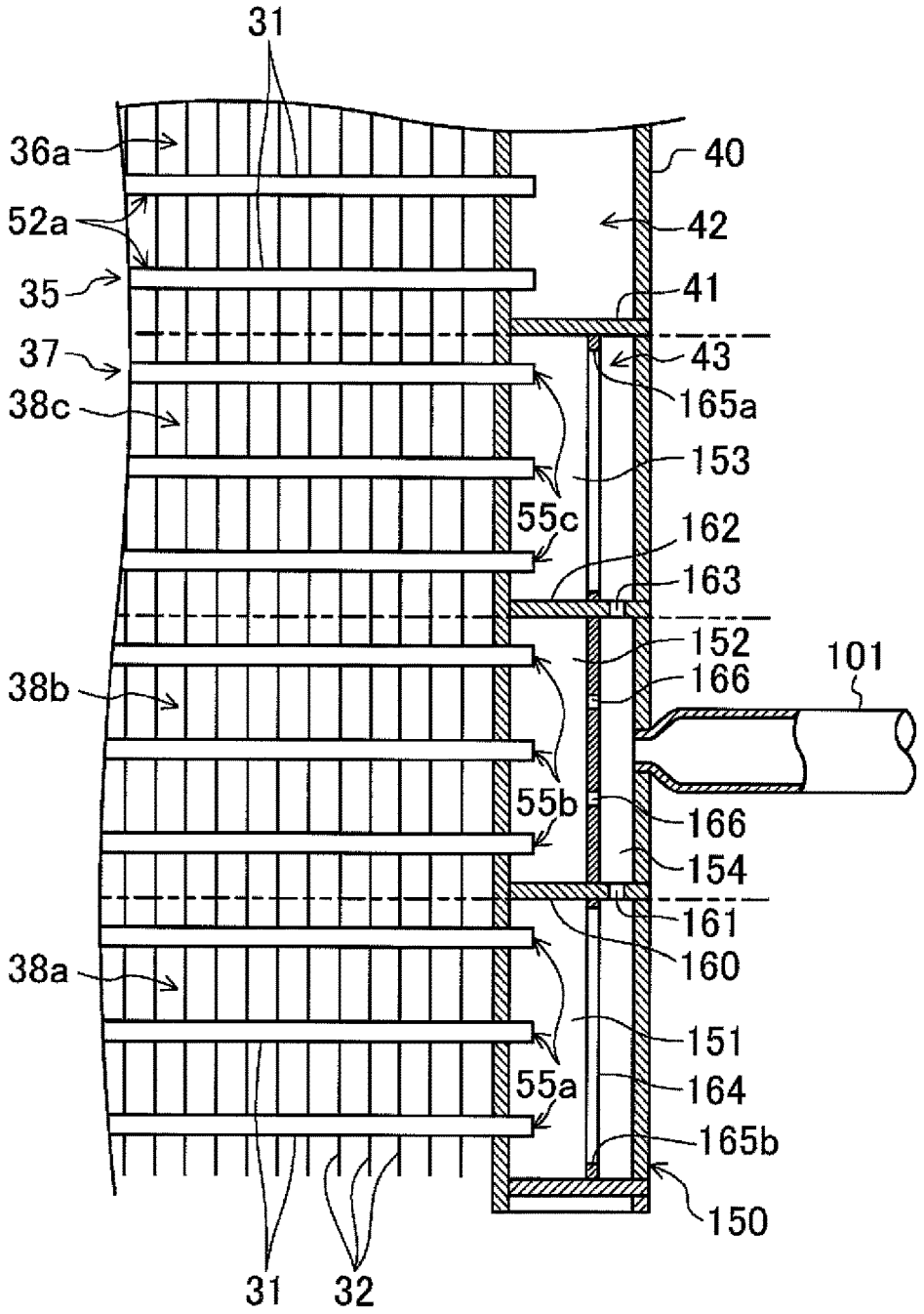
FIG. 7 illustrates an enlarged cross-sectional view of the vicinity of a lower space of the first header collecting pipe of the heat exchanger unit according to one or more embodiments, viewed from the front.

As illustrated in FIG. 6, each of the flat tubes (31) is a heat transfer pipe having a flat oblong cross section. As illustrated in FIG. 5, the plurality of flat tubes (31) each have its axial direction extending transversely, are arranged such that their flat side surfaces face each other. Further, the plurality of flat tubes (31) are arranged one above the other at regular intervals. That is, the axial directions of the respective flat tubes (31) are substantially parallel to one another. Each flat tube (31) has one end inserted in the first header collecting pipe (40), and the other end inserted in the second header collecting pipe (70). The flat tubes (31) in the heat exchanger unit (30) constitutes a tube bank (50).

As illustrated in FIG. 6, each of the flat tubes (31) comprises a plurality of fluid passages (175). The fluid passages (175) each extend in the axial direction of the flat tube (31), and are each aligned in the width direction of the flat tube (31). The respective fluid passages (175) are open at both end surfaces of the flat tube (31). The refrigerant supplied to the heat exchanger unit (30) exchanges heat with the air while flowing through the fluid passages (175) in the flat tubes (31).

As illustrated in FIG. 6, the fin (32) is a vertically-elongated plate fin formed by pressing a metal plate. The fin (32) has a large number of long narrow notches (186) extending in the width direction of the fin (32) from the front edge (i.e., the windward edge portion) of the fin (32). In the fin (32), the large number of notches (186) are formed at regular intervals in the longitudinal direction (the vertical direction) of the fin (32). A leeward portion of the notch (186) serves as a tube insertion portion (187). The flat tube (31) is inserted in the tube insertion portion (187) of the fin (32), and is joined to a peripheral edge portion of the tube insertion portion (187) by brazing. Also, the fin (32) comprises louvers (185) for promoting heat transfer. The plurality of fins (32) are arranged at regular intervals in the axial direction of the flat tube (31).

As illustrated in FIGS. 3 and 5, the heat exchanger unit (30) is divided into two heat exchange regions (35, 37) located one above the other. In the heat exchanger unit (30), the upper heat exchange region serves as the principal heat exchange region (35), and the lower heat exchange region serves as the auxiliary heat exchange region (37).

In the heat exchanger unit (30), the flat tubes (31) located in the principal heat exchange region (35) constitute a principal bank portion (51), and the flat tubes (31) located in the auxiliary heat exchange region (37) constitute an auxiliary bank portion (54). In other words, some of the flat tubes (31) which constitute the tube bank (50) constitute the auxiliary bank portion (54), and the other flat tubes (31) constitute the principal bank portion (51). As will be described in detail later, the number of the flat tubes (31) constituting the auxiliary bank portion (54) is less than that of the flat tubes (31) constituting the principal bank portion (51).

The principal heat exchange region (35) is divided into six principal heat exchange portions (36*a*-36*f*) located one above the other. On the other hand, the auxiliary heat exchange region (37) is divided into three auxiliary heat exchange portions (38*a*-38*c*) located one above the other. The numbers of the principal heat exchange portions (36*a*-36*f*) and the auxiliary heat exchange portions (38*a*-38*c*) disclosed herein are merely examples.

The principal heat exchange region (35) includes a first principal heat exchange portion (36*a*), a second principal heat exchange portion (36*b*), a third principal heat exchange portion (36*c*), a fourth principal heat exchange portion (36*d*), a fifth principal heat exchange portion (36*e*), and a sixth principal heat exchange portion (36*f*) in this order from bottom to top. Twelve flat tubes (31) are disposed in each of the principal heat exchange portions (36*a*-36*f*).

The twelve flat tubes (31) disposed in the first principal heat exchange portion (36*a*) constitute a first principal bank block (52*a*). The twelve flat tubes (31) disposed in the second principal heat exchange portion (36*b*) constitute a second principal bank block (52*b*). The twelve flat tubes (31) disposed in the third principal heat exchange portion (36*c*) constitute a third principal bank block (52*c*). The twelve flat tubes (31) disposed in the fourth principal heat exchange portion (36*d*) constitute a fourth principal bank block (52*d*). The twelve flat tubes (31) disposed in the fifth principal heat exchange portion (36*e*) constitute a fifth principal bank block (52*e*). The twelve flat tubes (31) disposed in the sixth principal heat exchange portion (36*f*) constitute a sixth principal bank block (52*f*). The numbers of flat tubes (31) which constitute the respective principal bank blocks (52*a*-52*f*) need not match with one another.

The first principal bank block (52*a*) and the second principal bank block (52*b*) constitute a first principal bank block group (53*a*). The third principal bank block (52*c*) and the fourth principal bank block (52*d*) constitute a second principal bank block group (53*b*). The fifth principal bank block (52*e*) and the sixth principal bank block (52*f*) constitute a third principal bank block group (53*c*).

The auxiliary heat exchange region (37) includes a first auxiliary heat exchange portion (38*a*), a second auxiliary heat exchange portion (38*b*), and a third auxiliary heat exchange portion (38*c*) in this order from bottom to top. Three flat tubes (31) are disposed in each of the auxiliary heat exchange portions (38*a*-38*c*).

The three flat tubes (31) disposed in the first auxiliary heat exchange portion (38*a*) constitute a first auxiliary bank block (55*a*). The three flat tubes (31) disposed in the second auxiliary heat exchange portion (38*b*) constitute a second auxiliary bank block (55*b*). The three flat tubes (31) disposed in the third auxiliary heat exchange portion (38*c*) constitute a third auxiliary bank block (55*c*). The numbers of flat tubes (31) which constitute the respective auxiliary bank blocks (55*a*-55*c*) need not match with one another.

As illustrated in FIG. 5, the inner space of the first header collecting pipe (40) is divided into upper and lower spaces by a partition plate (41). In the first header collecting pipe (40), the space above the partition plate (41) is an upper space (42), and the space below the partition plate (41) is a lower space (43).

The upper space (42) communicates with all the flat tubes (31) that constitute the principal bank portion (51). A gas connection pipe (102) is connected to a portion of the first header collecting pipe (40) forming the upper space (42). The pipe (18) in the refrigerant circuit (20) is connected to this gas connection pipe (102).

A liquid connection pipe (101) is connected to a portion of the first header collecting pipe (40) forming the lower space (43). The pipe (17) in the refrigerant circuit (20) is connected to this liquid connection pipe (101). As will be described in detail later, the portion of the first header collecting pipe (40) forming the lower space (43) serves as a distributer (150) for distributing the refrigerant to the three auxiliary heat exchange portions (38*a*-38*c*).

As illustrated in FIG. 5, the inner space of the second header collecting pipe (70) is divided into upper and lower spaces by a partition plate (71). In the second header collecting pipe (70), the space above the partition plate (71) is an upper space (72), and the space below the partition plate (71) is a lower space (73).

The upper space (72) is divided into six principal communication spaces (75*a*-75*f*) by five partition plates (74). That is, the second header collecting pipe (70) includes, above the partition plate (71), a first principal communication space (75*a*), a second principal communication space (75*b*), a third principal communication space (75*c*), a fourth principal communication space (75*d*), a fifth principal communication space (75*e*), and a sixth principal communication space (75*f*) in this order from bottom to top.

The twelve flat tubes (31), which comprise the first principal bank block (52*a*), communicate with the first principal communication space (75*a*). The twelve flat tubes (31), which comprise the second principal bank block (52*b*), communicate with the second principal communication space (75*b*). The twelve flat tubes (31), which comprise the third principal bank block (52*c*), communicate with the third principal communication space (75*c*). The twelve flat tubes (31), which comprise the fourth principal bank block (52*d*), communicate with the fourth principal communication space (75*d*). The twelve flat tubes (31), which comprise the fifth principal bank block (52*e*), communicate with the fifth principal communication space (75*e*). The twelve flat tubes (31), which comprise the sixth principal bank block (52*f*), communicate with the sixth principal communication space (75*f*).

As will be described in detail later, the first to sixth principal communication spaces (75*a*-75*f*) serve as an upstream communication space in communication with the upstream side of the plurality of flat tubes (31) when the outdoor heat exchanger (23) functions as an evaporator. Each of the principal communication spaces (75*a*-75*f*) comprises a distributing structure (90) for distributing the refrigerant to the plurality of flat tubes (31) associated with one of the principal communication spaces (75*a*-75*f*).

The lower space (73) is divided into three auxiliary communication spaces (77*a*-77*c*) by two partition plates (76). That is, the second header collecting pipe (70) includes, below the partition plate (71), a first auxiliary communication space (77*a*), a second auxiliary communication space (77*b*), and a third auxiliary communication space (77*c*) in this order from bottom to top.

The three flat tubes (31), which comprise the first auxiliary bank block (55*a*), communicate with the first auxiliary communication space (77*a*). The three flat tubes (31), which comprise the second auxiliary bank block (55*b*), communicate with the second auxiliary communication space (77*b*). The three flat tubes (31), which comprise the third auxiliary bank block (55*c*), communicate with the third auxiliary communication space (77*c*).

Three connection pipes (110, 120, 130) are attached to the second header collecting pipe (70). Each of the connection pipes (110, 120, 130) includes one principal pipe portion (111, 121, 131) and two branch pipe portions (112*a*, 112*b*, 122*a*, 122*b*, 132*a*, 132*b*) connected to an end of the principal pipe portion (111, 121, 131).

The first connection pipe (110) connects the first auxiliary bank block (55*a*) with the first principal bank block group (53*a*). Specifically, in the first connection pipe (110), the open end of the principal pipe portion (111) communicates with the first auxiliary communication space (77*a*). The open end of the branch pipe portion (112*a*) communicates with the first principal communication space (75*a*), and the open end of the branch pipe portion (112*b*) communicate with the second principal communication space (75*b*). That is, the first auxiliary communication space (77*a*) is connected to both of the first principal communication space (75*a*) associated with the first principal bank block (52*a*), and the second principal communication space (75*b*) associated with the second principal bank block (52*b*).

The second connection pipe (120) connects the second auxiliary bank block (55*b*) with the second principal bank block group (53*b*). Specifically, in the second connection pipe (120), the open end of the principal pipe portion (121) communicates with the second auxiliary communication space (77*b*). The open end of the branch pipe portion (122*a*) communicates with the third principal communication space (75*c*), and the open end of the branch pipe portion (122*b*) communicates with the fourth principal communication space (75*d*). That is, the second auxiliary communication space (77*b*) is connected to both of the third principal communication space (75*c*) associated with the third principal bank block (52*c*), and the fourth principal communication space (75*d*) associated with the fourth principal bank block (52*d*).

The third connection pipe (130) connects the third auxiliary bank block (55*c*) with the third principal bank block group (53*c*). Specifically, in the third connection pipe (130), the open end of the principal pipe portion (131) communicates with the third auxiliary communication space (77*c*). The open end of the branch pipe portion (132*a*) communicates with the fifth principal communication space (75*e*), and the open end of the branch pipe portion (132*b*) communicates with the sixth principal communication space (75*f*). That is, the third auxiliary communication space (77*c*) is connected to both of the fifth principal communication space (75*e*) associated with the fifth principal bank block (52*e*), and the sixth principal communication space (75*f*) associated with the sixth principal bank block (52*f*).

As will be described later, each of the branch pipe portions (112*a*, 112*b*, 122*a*, 122*b*, 132*a*, 132*b*) serves as an inlet portion for introducing the refrigerant into the principal communication space (75*a*-75*f*) when the outdoor heat exchanger (23) functions as an evaporator.

<Configuration of Distributer>

As can be seen from the foregoing, the portion of the first header collecting pipe (40) forming the lower space (43) serves as the distributer (150). The distributer (150), when the outdoor heat exchanger (23) functions as an evaporator, distributes the gas-liquid two-phase refrigerant supplied to the outdoor heat exchanger (23) into the three auxiliary heat exchange portions (38*a*-38*c*). In the following description, the distributer (150) will be described with reference to FIG. 7.

The lower space (43) comprises two horizontal partition plates (160, 162) and one vertical partition plate (164). The lower space (43) is divided by the two horizontal partition plates (160, 162) and the one vertical partition plate (164) into three communicating chambers (151-153) and one mixing chamber (154).

Specifically, each of the horizontal partition plates (160, 162) is arranged so as to cross the lower space (43), and divides the lower space (43) vertically. The lower horizontal partition plate (160) is arranged between the first auxiliary bank block (55*a*) and the second auxiliary bank block (55*b*). The upper horizontal partition plate (162) is arranged between the second auxiliary bank block (55*b*) and the third auxiliary bank block (55*c*). The vertical partition plate (164) is an elongated rectangular plate-like member. The vertical partition plate (164) is arranged so as to extend in the axial direction of the first header collecting pipe (40), and divides the lower space (43) into a space closer to the flat tube (31) and a space closer to the liquid connection pipe (101).

Upper and lower portions of the vertical partition plate (164) are provided with relatively large rectangular openings (165*a*, 165*b*). The opening (165*a*) formed at the upper portion of the vertical partition plate (164) is located above the upper horizontal partition plate (162). The opening (165*b*) formed at the lower portion of the vertical partition plate (164) is located below the lower horizontal partition plate (160).

In the lower space (43), the portion below the lower horizontal partition plate (160) serves as the first communicating chamber (151), and the portion above the upper horizontal partition plate (162) serves as the third communicating chamber (153). The first communicating chamber (151) communicates with the three flat tubes (31) which comprise the first auxiliary bank block (55*a*). The third communicating chamber (153) communicates with the three flat tubes (31) which comprise the third auxiliary bank block (55*c*).

The lower space (43) at a portion between the lower horizontal partition plate (160) and the upper horizontal partition plate (162) is divided, by the vertical partition plate (164), into a second communicating chamber (152) closer to the flat tubes (31), and a mixing chamber (154) closer to the liquid connection pipe (101). The second communicating chamber (152) communicates with the three flat tubes (31) which comprise the second auxiliary bank block (55*b*). The mixing chamber (154) communicates with the liquid connection pipe (101).

The lower horizontal partition plate (160) comprises a communication-through-hole (161) at a portion facing the mixing chamber (154). The first communicating chamber (151) communicates with the mixing chamber (154) through the communication-through-hole (161). The upper horizontal partition plate (162) a communication-through-hole (163) at a portion facing the mixing chamber (154). The third communicating chamber (153) communicates with the mixing chamber (154) through the communication-through-hole (163). The vertical partition plate (164) comprises a communication-through-hole (166) at a portion facing the mixing chamber (154). The second communicating chamber (152) communicates with the mixing chamber (154) through the communication-through-hole (166).

In the distributer (150), each of the communication-through-hole (161) in the lower horizontal partition plate (160), the communication-through-hole (163) in the upper horizontal partition plate (162), and the communication-through-hole (166) in the vertical partition plate (164) is a through hole having a relatively small diameter. In the distributer (150), the opening area (specifically the diameter) of each of these communication-through-holes (161, 163, 166) is designed such that the refrigerant is distributed into each of the auxiliary bank blocks (55*a*-55*c*) at a predetermined rate.

<Distributing Structure in Communication Spaces>

As can be seen from the foregoing, the first to sixth principal communication spaces (75*a*-75*f*) are the upstream communication spaces in communication with the upstream side of the plurality of flat tubes (31) when the outdoor heat exchanger (23) functions as an evaporator. Each of the principal communication spaces (75*a*-75*f*) comprises the distributing structure (90) for distributing the refrigerant to the plurality of flat tubes (31) in communication with associated one of the principal communication spaces (75*a*-75*f*). The distributing structure (90) distributes, when the outdoor heat exchanger (23) functions as an evaporator, the gas-liquid two-phase refrigerant, introduced into the principal communication space (75*a*-75*f*), into the twelve flat tubes (31). The distributing structures (90) provided in the respective principal communication spaces (75*a*-75*f*) have the same or similar structure. Thus, in the following description, the distributing structure (90) of the first principal communication space (75*a*) will be described with reference to FIGS. 8-10, and the explanation of the distributing structures (90) of the second to sixth principal communication spaces (75*b*-75*f*) will be omitted.

The distributing structure (90) includes one vertical partition plate (91) and one division plate (92).

The vertical partition plate (91) is a vertically-elongated rectangular plate-like member, and arranged so as to extend in the axial direction of the first header collecting pipe (40). The vertical partition plate (91) divides the first principal communication space (75*a*) into two horizontally aligned spaces. For example, the vertical partition plate (91) divides the first principal communication space (75*a*) into a first space (93) closer to the flat tubes, and a second space (94) closer to the inlet portion. The first space (93) communicates with the plurality of flat tubes (31). The second space (94) communicates with the branch pipe portion (112*a*) of the first connection pipe (110) which serves as an inlet portion for introducing the refrigerant into the first principal communication space (75*a*) when the outdoor heat exchanger (23) functions as an evaporator. The vertical partition plate (91) is arranged to be perpendicular to the plurality of flat tubes (31) inserted in the first principal communication space (75*a*). In one or more embodiments, the distance between the vertical partition plate (91) and the end faces of the plurality of flat tubes (31) is designed to be about 2 mm.

A rectangular through hole (91*a*) is formed in a lower portion of the vertical partition plate (91). The through hole (91*a*) is located below the lowermost one of the twelve flat tubes (31) that communicate with the first principal communication space (75*a*).

On the other hand, the division plate (92) is an approximately circular plate-like member, and is arranged to cross the first principal communication space (75*a*). The division plate (92) is provided, at a central portion thereof, with a rectangular through hole (92*a*) which extends in the diameter direction. The vertical partition plate (91) is inserted in the through hole (92*a*). The division plate (92) is fitted in a lateral hole formed in the second header collecting pipe (70), and is attached to the second header collecting pipe (70) by brazing. The vertical partition plate (91) is fixed to the second header collecting pipe (70) by brazing, to the second header collecting pipe (70), the division plate (92) in which the vertical partition plate (91) is inserted through the through hole (92*a*).

Further, the division plate (92) divides each of the first space (93) and the second space (94) into two upper and lower spaces. The division plate (92) has a first portion closer to the first space (93), and the first portion comprises two openings (92*b*, 92*b*). These two openings (92*b*, 92*b*) are formed at locations corresponding, in the vertical direction, to fan-shaped gaps between the flat tube (31) inserted in the first space (93) and the inner wall of the second header collecting pipe (70). The two openings (92*b*, 92*b*) each have a similar shape as the gap. These two openings (92*b*, 92*b*) allow the upper space (95) and the lower space (96) of the first space (93) above and below the division plate (92) to communicate with each other.

On the other hand, the second portion of the division plate (92) closer to the second space (94) is not provided with an opening. Thus, the second portion divides the second space (94) into two upper and lower spaces (97, 98). In other words, the upper space (97) and the lower space (98) of the second space (94) above and below the division plate (92) do not communicate with each other. The division plate (92) is located above the branch pipe portion (112*a*) of the first connection pipe (110), that is, above the inlet portion which introduces the refrigerant into the second space (94) when the outdoor heat exchanger (23) functions as an evaporator, and above the through hole (91*a*). Further, in one or more embodiments, the division plate (92) is located between the lowermost one of the twelve flat tubes (31) inserted in the first space (93) and the second from the lowermost. In this manner, the lower space (98) of the second space (94) below the division plate (92) serves as a refrigerant inlet space with which the branch pipe portion (112*a*) of the first connection pipe (110) communicates.

In the distributing structure (90), the location of the vertical partition plate (91), the opening area of the through hole (91*a*) of the vertical partition plate (91), and the opening areas of the two openings (92*b*, 92*b*) of the division plate (92) are designed such that the flow rate of the refrigerant which has flowed into the bottom of the first space (93) is set to such a flow rate that allows the refrigerant to be uniformly distributed to the respective flat tubes (31).

<Refrigerant Flow in Outdoor Heat Exchanger Functioning as Condenser>

During a cooling operation of the air conditioner (10), the outdoor heat exchanger (23) functions as a condenser. A refrigerant flow in the outdoor heat exchanger (23) during the cooling operation will be described below.

The gas refrigerant discharged from the compressor (21) is supplied to the outdoor heat exchanger (23) through the pipe (18). As illustrated in FIG. 3, the refrigerant supplied to the gas connection pipe (102) through the pipe (18) sequentially passes through the flat tubes (31) comprising the principal bank portion (51), and the flat tubes (31) comprising the auxiliary bank portion (54), and then flows into the pipe (17) through the liquid connection pipe (101).

The refrigerant flow in the outdoor heat exchanger (23) will be described in detail.

As illustrated in FIG. 5, the gas single-phase refrigerant which has flowed into the upper space (42) of the first header collecting pipe (40) from the gas connection pipe (102) is diverged into the flat tubes (31) comprising the respective principal bank blocks. The refrigerant flowing in the flat tubes (31) of the principal bank blocks (52*a*-52*f*) exchanges heat with the outdoor air supplied to the outdoor heat exchanger (23). The refrigerant which has passed through the flat tubes (31) of each of the principal bank blocks (52*a*-52*f*) flows into one of the associated principal communication spaces (75*a*-75*f*) in the second header collecting pipe (70). The refrigerant, which has passed through the flat tubes (31) of the first principal bank block (52*a*) enters, and is merged together in, the first principal communication space (75*a*). The refrigerant, which has passed through the flat tubes (31) of the second principal bank block (52*b*) enters, and is merged together in, the second principal communication space (75*b*). The refrigerant which has passes through the flat tubes (31) of the third principal bank block (52*c*) enters, and is merged together in, the third principal communication space (75*c*). The refrigerant, which has passed through the flat tubes (31) of the fourth principal bank block (52*d*) enters, and is merged together in, the fourth principal communication space (75*d*). The refrigerant, which has passed through the flat tubes (31) of the fifth principal bank block (52*e*) enters, and is merged together in, the fifth principal communication space (75*e*). The refrigerant, which has passed through the flat tubes (31) of the sixth principal bank block (52*f*) enters, and is merged together in, the sixth principal communication space (75*f*).

The refrigerant in the first principal communication space (75*a*) and the second principal communication space (75*b*) passes through the first connection pipe (110) to flow into the first auxiliary communication space (77*a*). The refrigerant in the third principal communication space (75*c*) and the fourth principal communication space (75*d*) passes through the second connection pipe (120) to flow into the second auxiliary communication space (77*b*). The refrigerant in the fifth principal communication space (75*e*) and the sixth principal communication space (75*f*) passes through the third connection pipe (130) to flow into the third auxiliary communication space (77*c*).

The refrigerant in each of the auxiliary communication spaces (77*a*-77*c*) flows into the flat tubes (31) of the associated one of the auxiliary bank blocks (55*a*-55*c*). The refrigerant in the first auxiliary communication space (77*a*) flows into the flat tubes (31) of the first auxiliary bank block (55*a*). The refrigerant in the second auxiliary communication space (77*b*) flows into the flat tubes (31) of the second auxiliary bank block (55*b*). The refrigerant in the third auxiliary communication space (77*c*) flows into the flat tubes (31) of the third auxiliary bank block (55*c*).

The refrigerant flowing in the flat tubes (31) of the auxiliary bank blocks (55*a*-55*c*) exchanges heat with the outdoor air supplied to the outdoor heat exchanger (23). The refrigerant which has passed through the flat tubes (31) of each of the auxiliary bank blocks (55*a*-55*c*) flows in the associated one of the communicating chambers (151-153). The refrigerant, which has passed through the flat tubes (31) of the first auxiliary bank block (55*a*) enters, and is merged together in, the first communicating chamber (151). The refrigerant, which has passed through the flat tubes (31) of the second auxiliary bank block (55*b*) enters, and is merged together in, the second communicating chamber (152). The refrigerant, which has passed through the flat tubes (31) of the third auxiliary bank block (55*c*) enters, and is merged together in, the third communicating chamber (153). The refrigerant in each of the communicating chambers (151-153) enters, and is merged together in, the mixing chamber (154), and thereafter discharged from the outdoor heat exchanger (23) through the liquid connection pipe (101).

<Refrigerant Flow in Outdoor Heat Exchanger Functioning as Evaporator>

During a heating operation of the air conditioner (10), the outdoor heat exchanger (23) functions as an evaporator. A refrigerant flow in the outdoor heat exchanger (23) during the heating operation will be described below.

Figure 4:
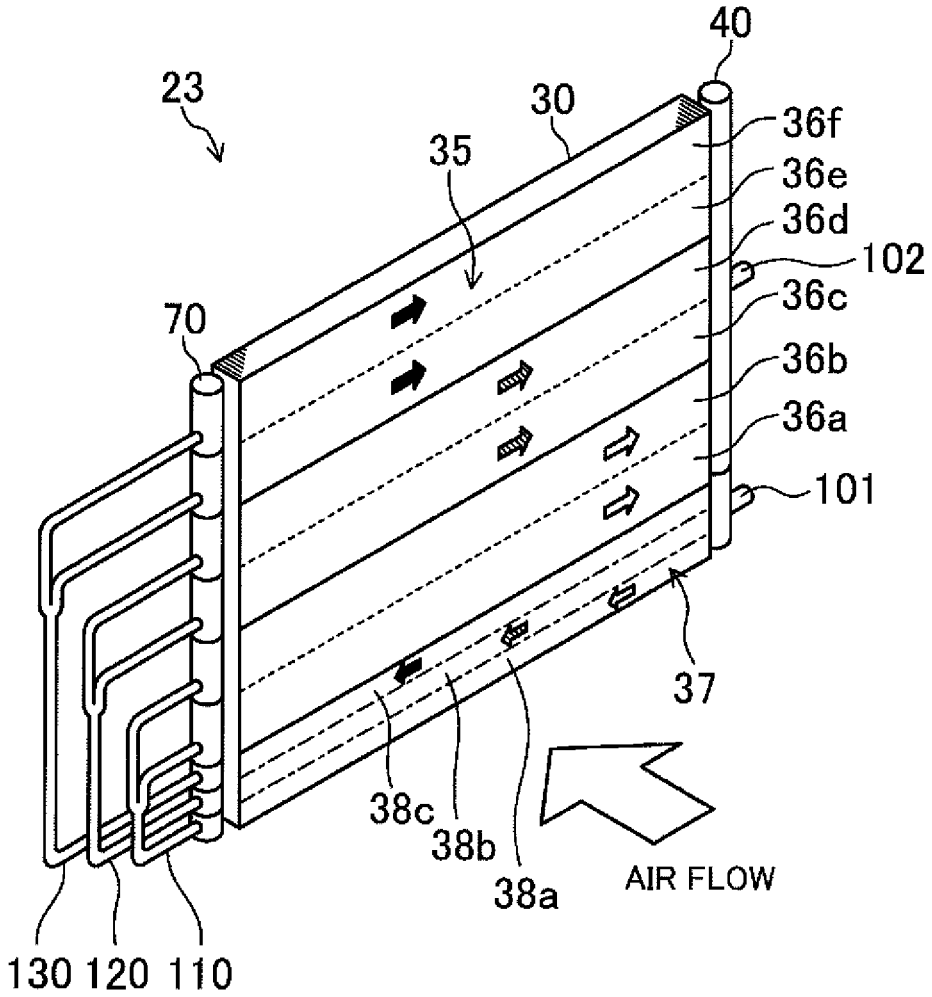
FIG. 4 generally illustrates a perspective view of the heat exchanger unit according to one or more embodiments, and shows the refrigerant flow when the outdoor heat exchanger functions as an evaporator.

The refrigerant which has expanded while passing through the expansion valve (24) and turned into a gas-liquid two-phase refrigerant is supplied to the outdoor heat exchanger (23) through the pipe (17). As illustrated in FIG. 4, the refrigerant supplied to the liquid connection pipe (101) through the pipe (17) sequentially passes through the flat tubes (31) comprising the auxiliary bank portion (54), and the flat tubes (31) comprising the principal bank portion (51), and flows into the pipe (18) through the gas connection pipe (102).

The refrigerant flow in the outdoor heat exchanger (23) will be described in detail.

As illustrated in FIG. 5, the gas-liquid two-phase refrigerant which has flowed into the mixing chamber (154) through the liquid connection pipe (101) is distributed to the three communicating chambers (151-153), and thereafter flows into the flat tubes (31) of the auxiliary bank blocks (55*a*-55*c*) associated with the communicating chambers (151-153). The refrigerant flowing through the flat tubes (31) of the auxiliary bank blocks (55*a*-55*c*) exchanges heat with the outdoor air supplied to the outdoor heat exchanger (23). The refrigerant which has passed through the three flat tubes (31) of each of the auxiliary bank blocks (55*a*-55*c*) enters, and is merged together in, the auxiliary communication space (77*a*-77*c*) of the second header collecting pipe (70) associated with the auxiliary bank block (55*a*-55*c*).

Part of the refrigerant which has flowed into the principal pipe portion (111) of the first connection pipe (110) from the first auxiliary communication space (77*a*) flows into the first principal communication space (75*a*) through the branch pipe portion (112*a*), and the rest of said refrigerant flows into the second principal communication space (75*b*) through the branch pipe portion (112*b*). Part of the refrigerant which has flowed into the principal pipe portion (121) of the second connection pipe (120) from the second auxiliary communication space (77*b*) flows into the third principal communication space (75*c*) through the branch pipe portion (122*a*), and the rest of said refrigerant flows into the fourth principal communication space (75*d*) through the branch pipe portion (122*b*). Part of the refrigerant which has flowed into the principal pipe portion (131) of the third connection pipe (130) from the third auxiliary communication space (77*c*) flows into the fifth principal communication space (75*e*) through the branch pipe portion (132*a*), and the rest of said refrigerant flows into the sixth principal communication space (75*f*) through the branch pipe portion (132*b*).

The refrigerant which has flowed into the principal communication spaces (75*a*-75*f*) of the second header collecting pipe (70) is distributed, by the distributing structure (90), to the twelve flat tubes (31) of each of the principal bank block (52*a*-52*f*) associated with the principal communication space (75*a*-75*f*). The flow division of the refrigerant in the principal communication spaces (75*a*-75*f*) into their associated flat tubes (31) will be described in detail later. The refrigerant in the first principal communication space (75*a*) flows into the flat tubes (31) comprising the first principal bank block (52*a*). The refrigerant in the second principal communication space (75*b*) flows into the flat tubes (31) comprising the second principal bank block (52*b*). The refrigerant in the third principal communication space (75*c*) flows into the flat tubes (31) comprising the third principal bank block (52*c*). The flat tubes (31) in the fourth principal communication space (75*d*) flows into the flat tubes (31) comprising the fourth principal bank block (52*d*). The refrigerant in the fifth principal communication space (75*e*) flows into the flat tubes (31) comprising the fifth principal bank block (52*e*). The refrigerant in the sixth principal communication space (75*f*) flows into the flat tubes (31) comprising the sixth principal bank block (52*f*).

The refrigerant flowing in the flat tubes (31) in the principal bank blocks (52*a*-52*f*) exchanges heat with the outdoor air supplied to the outdoor heat exchanger (23). The refrigerant which has passed through the twelve flat tubes (31) of each of the principal bank blocks (52*a*-52*f*) enters, and is merged together in, the upper space (42) of the first header collecting pipe (40), and thereafter flows out of the outdoor heat exchanger (23) through the gas connection pipe (102).

<<Flow Division in Principal Communication Space>>

Now, flow division of the refrigerant in each of the principal communication spaces (75*a*-75*f*) into associated flat tubes (31) will be described in detail. The distributing structures (90) of the respective principal communication spaces (75*a*-75*f*) have the same or similar structure. Thus, the flow of the refrigerant is divided in the same or similar manner in the principal communication spaces (75*a*-75*f*). Hence, in the following description, the flow division of the refrigerant in the first principal communication space (75*a*) will be described with reference to FIGS. 8 and 9, and the explanation of the flow division in the second to sixth principal communication spaces (75*b*-75*f*) will be omitted.

Figure 8:
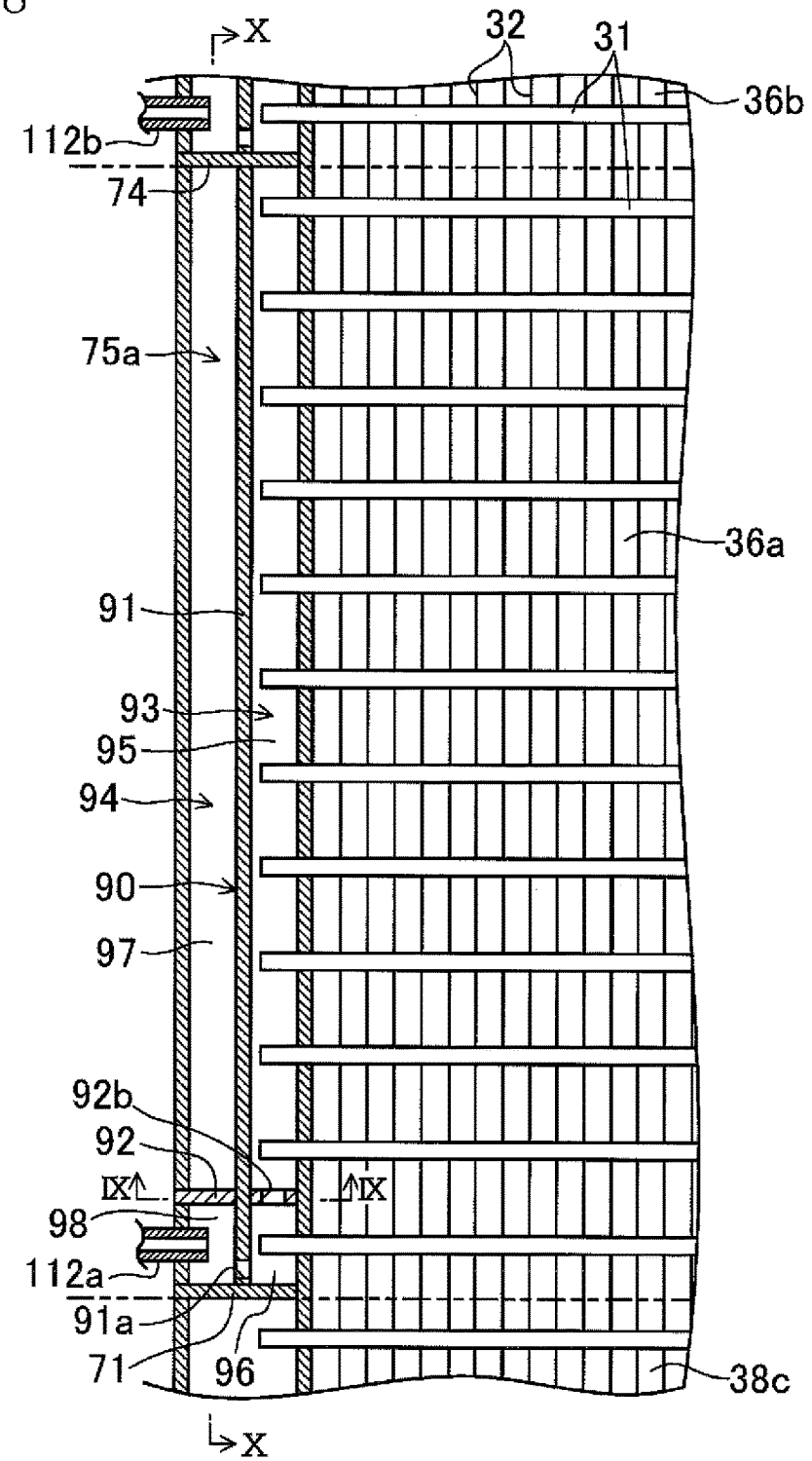
FIG. 8 illustrates an enlarged cross-sectional view of the vicinity of the first principal communication space of the second header collecting pipe of the heat exchanger unit according to one or more embodiments, viewed from the front.
Figure 9:
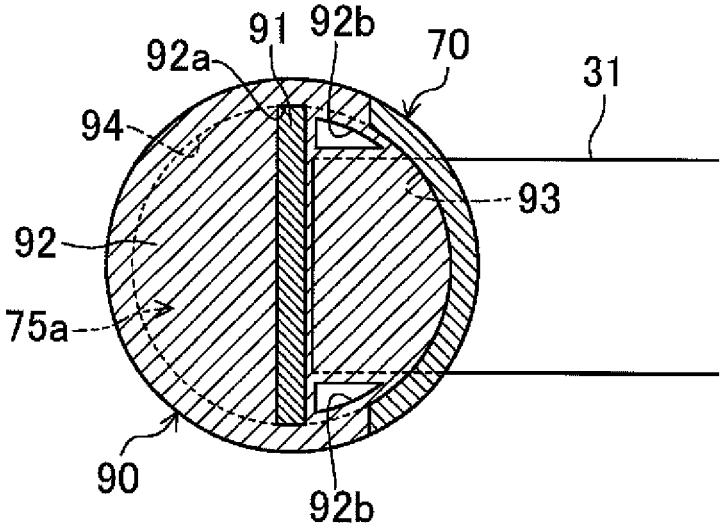
FIG. 9 illustrates a cross-sectional view of the heat exchanger unit taken along the plane IX-IX of FIG. 8.
Figure 10:
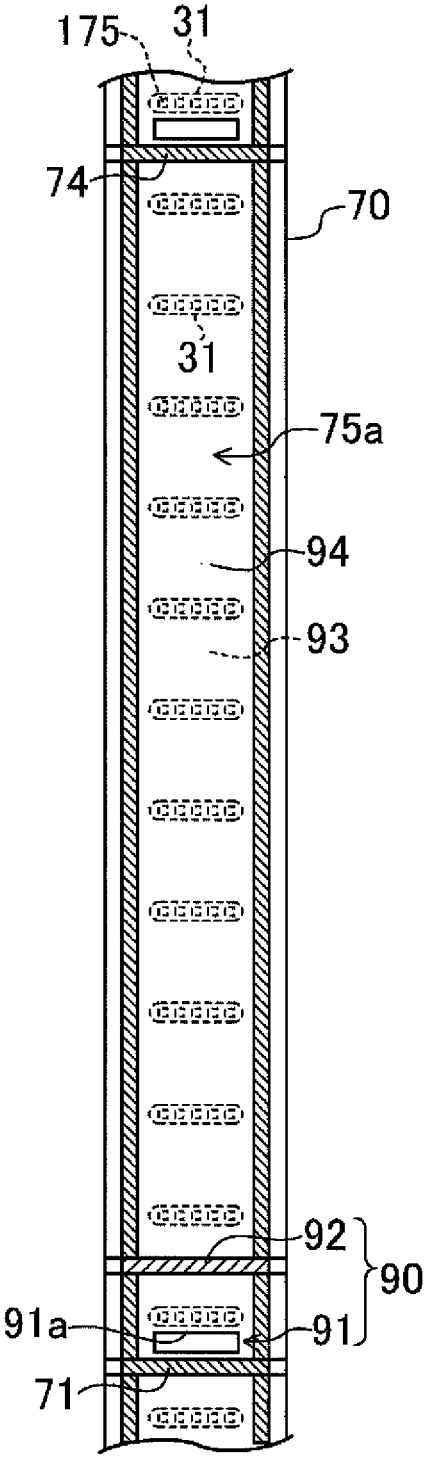
FIG. 10 illustrates a cross-sectional view of the heat exchanger unit taken along the plane X-X of FIG. 8.

As illustrated in FIG. 8, the gas-liquid two-phase refrigerant flowing into the first principal communication space (75*a*) is first introduced to the lower space (98) under the division plate (92) in the second space (94), through the branch pipe portion (112*a*) of the first connection pipe (110) serving as the inlet portion. The refrigerant introduced in the lower space (98) flows into the lower portion of the first space (93) closer to the flat tubes, via the through hole (91*a*) formed at a lower portion of the vertical partition plate (91). The refrigerant, which has flowed into the lower portion of the first space (93) flows up, in the first space (93), while passing through the gaps between the respective flat tubes (31) and the inner wall of the second header collecting pipe (70), and is distributed into the plurality of flat tubes (31) in communication with the first space (93).

Here, as described above, the provision of the vertical partition plate (91) in the first principal communication space (75*a*) significantly reduces the cross-sectional area of the flow path of the refrigerant flowing from the lower portion to the upper portion in the first principal communication space (75*a*), when the outdoor heat exchanger (23) functions as an evaporator. The flow rate of the refrigerant therefore significantly increases, compared to the case without the vertical partition plate (91). Thus, the liquid refrigerant, with greater density, of the gas-liquid two-phase refrigerant which has flowed into the first space (93) does not accumulate in the bottom of the first space (93), but is blown up fast against gravity together with the gas refrigerant. Consequently, the gas-liquid two-phase refrigerant in the state of mixture of the liquid and gas refrigerants flows into the respective flat tubes (31) in communication with the first space (93). In other words, the partition plate, which increases the flow rate of the refrigerant, reduces variations in the wetness of the refrigerant flowing into the respective flat tubes (31) from the first principal communication space (75*a*).

In one or more embodiments, the vertical partition plate (91) comprises the through hole (91*a*), which connects the first space (93) and the second space (94), below the lowermost one of the plurality of flat tubes (31) in communication with the first principal communication space (75*a*). In this structure, the through hole (91*a*) which connects the first space (93) and the second space (94) does not face any one of the open end faces of the flat tubes (31). Thus, the refrigerant which has flowed into the first space (93) from the second space (94) is not blown directly on a specific flat tube (31), and is uniformly distributed to the respective flat tubes (31) in communication with the first space (93).

—Advantages of First Aspect—

In the outdoor heat exchanger (23) of one or more embodiments, the cross-sectional area of the flow path of the refrigerant flowing from a lower portion to an upper portion of each of the principal communication spaces (75*a*-75*f*) can be significantly reduced by simply providing, in each of the first to sixth principal communication spaces (75*a*-75*f*) communicating with the upstream side of the plurality of flat tubes (31) when the outdoor heat exchanger (23) functions as an evaporator, the vertical partition plate (91) which divides the principal communication space (75*a*-75*f*) into the first space (93) closer to the flat tubes and the second space (94) closer to the inlet portion. This allows for significantly increasing the flow rate of the refrigerant flowing from the lower portion to the upper portion of the principal communication space (75*a*-75*f*), compared to the case without the vertical partition plate (91). In other words, the liquid refrigerant, with greater density, of the gas-liquid two-phase refrigerant which has flowed into the first space (93) does not accumulate in the bottom of the first space (93), but is blown up fast against gravity together with the gas refrigerant. Consequently, the gas-liquid two-phase refrigerant in the state of mixture of the liquid and gas refrigerants flows into the respective flat tubes (31) in communication with the first space (93). Thus, in the outdoor heat exchanger (23), variations in the wetness of the refrigerant flowing into the flat tubes (31) can be reduced by a simple structure, thereby allowing the outdoor heat exchanger (23) to exhibit sufficient performance.

Further, in the outdoor heat exchanger (23), the flow rate of the refrigerant flowing from the lower portion to the upper portion of the first space (93) can be easily changed by simply changing the location of the vertical partition plate (91) in the principal communication space (75*a*-75*f*). Thus, the flow rate of the refrigerant flowing from the lower portion to the upper portion of the principal communication space (75*a*-75*f*) can be adjusted to an appropriate rate by simply changing the location of the partition plate in the principal communication space (75*a*-75*f*) without complicated design modifications.

Further, in the outdoor heat exchanger (23), the through hole (91*a*) which connects the first space (93) and the second space (94) is formed in the vertical partition plate (91) at a location below the lowermost one of the plurality of flat tubes (31) in communication with the principal communication space (75*a*-75*f*). In this structure, the through hole (91*a*) does not face any one of the open end faces of the flat tubes (31). Thus, the refrigerant flowing into the first space (93) from the second space (94) is not blown directly on a specific flat tube (31). Accordingly, the refrigerant which has flowed into the first space (93) from the second space (94) can be uniformly distributed to the respective flat tubes (31) in communication with the first space (93).

Further, in the outdoor heat exchanger (23), a communication path which connects the first space (93) and the second space (94) can be easily formed by utilizing the through hole (91*a*) formed at a lower portion of the vertical partition plate (91).

Further, in the outdoor heat exchanger (23), the second space (94) comprises the division plate (92), which divides the second space (94) into the lower space (98) to which the refrigerant is introduced when the outdoor heat exchanger (23) functions as an evaporator, and the upper space (97) located above the lower space (98). In this structure, the lower space (98) as an inlet space to which the refrigerant is introduced when the outdoor heat exchanger (23) functions as an evaporator, is a small space. This structure allows for limiting a flow rate reduction of the refrigerant in the second space (94) to a lesser degree. Thus, the gas-liquid two-phase refrigerant can be blown up fast in the first space (93).

<<Second Aspect of the Invention>>

Embodiments of a second aspect of the present invention will be described below. The outdoor heat exchanger (23) according to one or more embodiments is obtained by modifying the configuration of the distributer (150) of the outdoor heat exchanger (23) of the first aspect. Only the differences from the first aspect will be described below.

<Configuration of Distributer>

Figure 11:
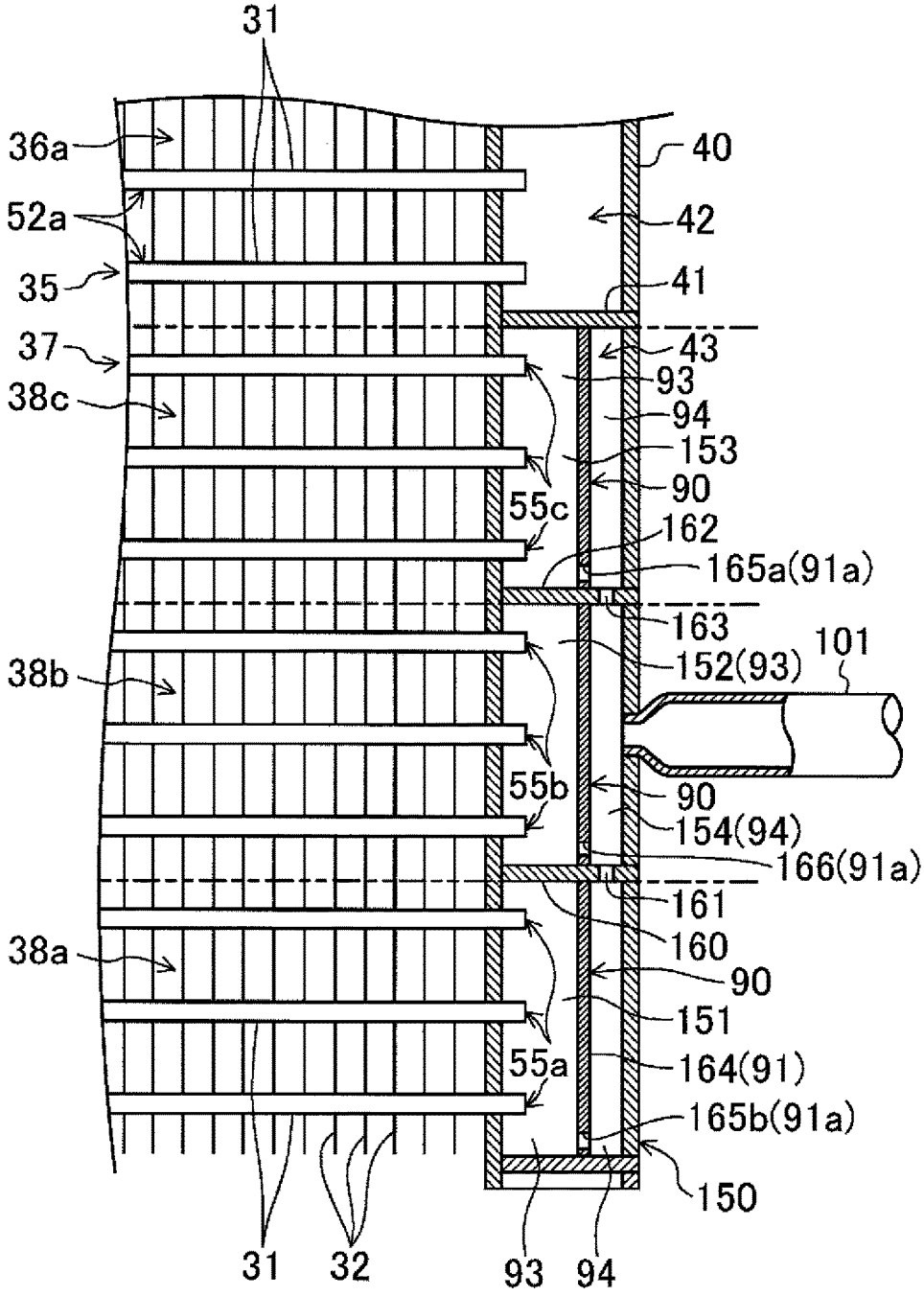
FIG. 11 illustrates an enlarged cross-sectional view of a lower space of the first header collecting pipe of a heat exchanger unit according to one or more embodiments, viewed from the front.
Figure 12:
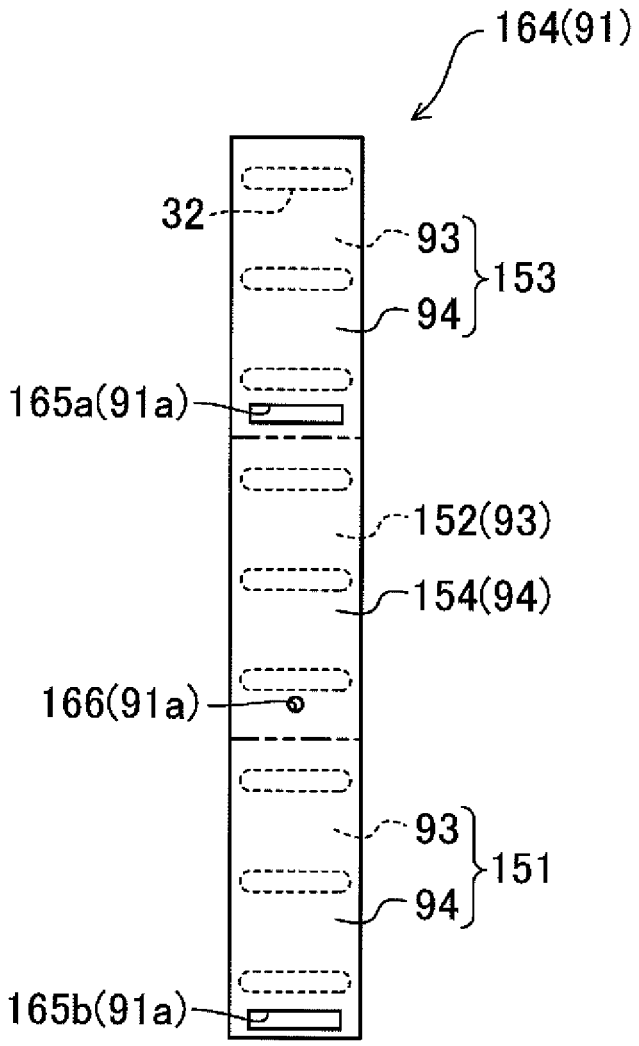
FIG. 12 illustrates a side view of a vertical partition plate disposed in the lower space of the first header collecting pipe of the heat exchanger unit according to one or more embodiments.

According to one or more embodiments, as illustrated in FIGS. 11 and 12, the lower space (43) of the first header collecting pipe (40) comprises two horizontal partition plates (160, 162) and one vertical partition plate (164). The lower space (43) is divided, by the two horizontal partition plates (160, 162), into three communication spaces, that is, a first communication space, a second communication space, and a third communication space, which are sequentially arranged from bottom to top. The first communication space corresponds to the first communicating chamber (151) of the first aspect. The second communication space corresponds to the space comprised of the second communicating chamber (152) and the mixing chamber (154) of the first aspect. The third communication space corresponds to the third communicating chamber (153) of the first aspect.

In one or more embodiments of the second aspect, each of the three communication spaces comprises a distributing structure (90) for distributing the refrigerant to the three flat tubes (31) in communication with the communication space. Each of the communication spaces is divided by the vertical partition plate (164) into a space closer to the flat tubes (31) and a space closer to the liquid connection pipe (101). That is, the vertical partition plate (164) serves as the partition plate (91) which divides each of the communication spaces into the first space (93) closer to the flat tubes and the second space (94) closer to the inlet portion (the liquid connection pipe (101) and the communication-through-holes (161,163)) for introducing the refrigerant into the respective communication spaces when the outdoor heat exchanger (23) functions as an evaporator. On the other hand, the vertical partition plate (164) comprises a through hole (91*a*), which connects the first space (93) and the second space (94) of each of the communication spaces, at a portion corresponding to a lower portion of the communication space.

In one or more embodiments, the opening (165*b*) formed at the lower portion of the vertical partition plate (164) is a rectangular through hole that is much smaller than that of the first aspect, and the opening (165*b*) is located below the lowermost one of the three flat tubes (31) in communication with the first communication space. With this structure, the opening (165*b*) formed at the lower portion of the vertical partition plate (164) serves as the through hole (91*a*) which connects the first space (93) and the second space (94) at the lower portion of the first communication space. On the other hand, the opening (165*a*) formed at the upper portion of the vertical partition plate (164) is a rectangular through hole that is much smaller than that of the first aspect, and the opening (165*a*) is located below the lowermost one of the three flat tubes (31) in communication with the third communication space. With this structure, the opening (165*a*) formed at the upper portion of the vertical partition plate (164) serves as the through hole (91*a*) which connects the first space (93) and the second space (94) at the lower portion of the third communication space. Further, the communication-through-hole (166) of the vertical partition plate (164) is a circular through hole equivalent to that of the first aspect, and only one communication-through-hole (166) is formed below the lowermost one of the three flat tubes (31) in communication with the second communication space. With this structure, the communication-through-hole (166) of the vertical partition plate (164) serves as the through hole (91*a*) which connects the first space (93) (the second communicating chamber (152)) and the second space (94) (the mixing chamber (154)) at the lower portion of the second communication space.

In this structure, according to one or more embodiments, the gas-liquid two-phase refrigerant which has flowed into the mixing chamber (154) through the liquid connection pipe (101) when the outdoor heat exchanger (23) functions as an evaporator, is distributed to the three communicating chambers (151-153), and thereafter flows into the flat tubes (31) of the auxiliary bank blocks (55*a*-55*c*) associated with the communicating chambers (151-153).

Here, in each of the communication spaces, the refrigerant introduced in the second space (94) flows into a lower portion of the first space (93) via the through hole (91*a*) formed at a lower portion of the second space (94). The refrigerant, which has flowed into the lower portion of the first space (93) flows up, in the first space (93), while passing through the gaps between the respective flat tubes (31) and the inner wall of the first header collecting pipe (40), and is distributed into the three flat tubes (31) in communication with the first space (93).

As described above, the vertical partition plate (91) is provided in each of the three communication spaces. Thus, the cross-sectional area of the flow path of the refrigerant flowing from a lower portion to an upper portion of each of the communication spaces when the outdoor heat exchanger (23) functions as an evaporator is significantly reduced. The flow rate of the refrigerant therefore significantly increases, compared to the case without the vertical partition plate (91). Thus, the liquid refrigerant, with greater density, of the gas-liquid two-phase refrigerant which has flowed into the first space (93) does not accumulate in the bottom of the first space (93), but is blown up fast against gravity together with the gas refrigerant. Consequently, the gas-liquid two-phase refrigerant in the state of mixture of the liquid and gas refrigerants flows into the respective flat tubes (31) in communication with the first space (93). In other words, the partition plate, which increases the flow rate of the refrigerant, reduces variations in the wetness of the refrigerant flowing from the communication space into the respective flat tubes (31) communicating with the communication space.

In one or more embodiments, the through hole (91*a*) which connects the first space (93) and the second space (94) in each of the communication spaces is located below the lowermost one of the three flat tubes (31) in communication with the communication space. In this structure, the through hole (91*a*) which connects the first space (93) and the second space (94) does not face any one of the open end faces of the flat tubes (31). Thus, the refrigerant which has flowed into the first space (93) from the second space (94) is not blown directly on a specific flat tube (31), and is uniformly distributed to the respective flat tubes (31) in communication with the first space (93).

In this manner, variations in the wetness of the refrigerant flowing into the flat tubes (31) can be reduced by a simple structure, not only in the communication spaces of the principal heat exchange portions, but also in the communication spaces of the auxiliary heat exchange portions. This allows the outdoor heat exchanger (23) to exhibit sufficient performance.

<<Third Aspect of the Invention>>

Embodiments of a third aspect of the present invention will be described below. The outdoor heat exchanger (23) according to one or more embodiments is obtained by partially modifying the structure of the distributing structure (90) of the outdoor heat exchanger (23) of the first aspect. Only the differences from the first aspect will be described below.

<Distributing structure in Communication Space>

In the first aspect, the division plate (92) divides the second space (94) into the lower space (98) below the division plate (92) and the upper space (97) above the division plate (92), and the upper space (97) is a closed space which does not communicate with the lower space (98) and the first space (93). The internal pressure of the closed upper space (97) of the second space (94) does not change even when the refrigerant is introduced in the outdoor heat exchanger (23), and remains at atmospheric pressure, which is a pressure when the outdoor heat exchanger (23) was assembled. On the other hand, the internal pressure of the lower space (98) of the second space (94) and the internal pressure of the first space (93) are higher, in general, than atmospheric pressure, since the refrigerant is introduced therein when the outdoor heat exchanger (23) functions as a condenser or an evaporator. In other words, when the outdoor heat exchanger (23) functions as a condenser or an evaporator, the refrigerant flows into the lower space (98) of the second space (94) and into the first space (93), and the internal pressures of the lower space (98) and the first space (93) become approximately equal to each other, whereas the upper space (97) of the second space (94) is a closed space that does not communicate with the first space (93) and the lower space (98) of the second space (94). This generates a difference in the internal pressure between the upper space (97), and the first space (93) and the lower space (98) of the second space (94). This pressure difference may cause, for example, a deformation in the second header collecting pipe (70) and the distributing structure (90) if the stiffness of the second header collecting pipe (70) and the distributing structure (90) is low.

Figure 13:
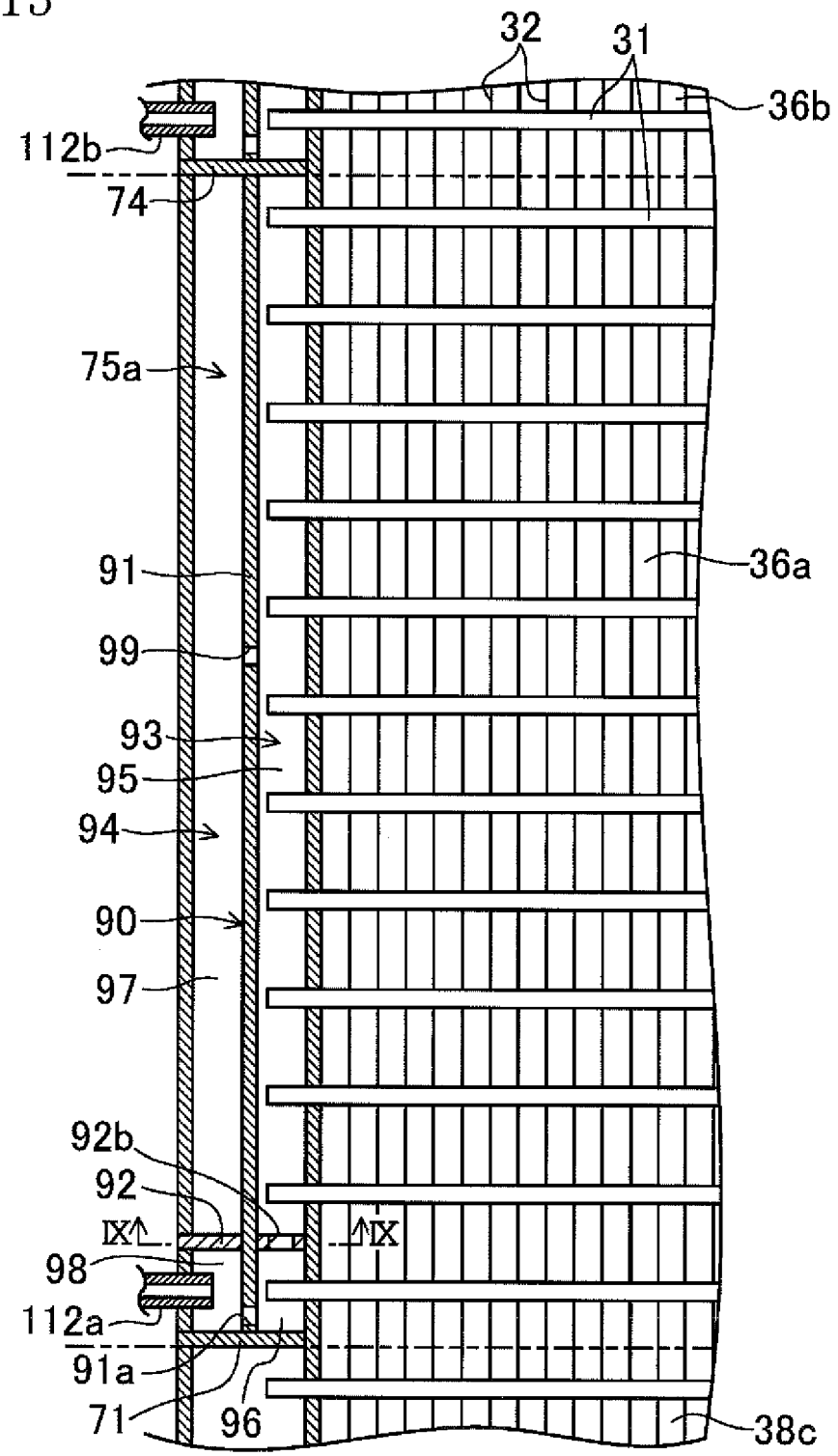
FIG. 13 illustrates an enlarged cross-sectional view of the vicinity of the first principal communication space of the second header collecting pipe of a heat exchanger unit according to one or more embodiments, viewed from the front.

To avoid this, as illustrated in FIG. 13, one or more embodiments of the third aspect provides a communication hole (99) for connecting the first space (93) and the upper space (97) of the second space (94), near the middle, in the vertical direction, of the vertical partition plate (91) of the distributing structure (90). The dimension and the shape of the communication hole (99) are designed such that the pressure in the first space (93) and the pressure in the upper space (97) of the second space (94) are immediately equalized, without interrupting the flow of the refrigerant in the first space (93), when the refrigerant flows through the outdoor heat exchanger (23).

In this structure, even if the internal pressures in the first space (93) and the lower space (98) of the second space (94) become higher than the internal pressure of the upper space (97) of the second space (94) when the outdoor heat exchanger (23) into which the refrigerant is introduced functions as a condenser or an evaporator, the refrigerant in the first space (93) flows into the upper space (97) of the second space (94) through the communication hole (99) until the internal pressures in the first space (93) and the upper space (97) are equalized.

In this manner, the internal pressure in the first space (93) and the internal pressure in the upper space (97) of the second space (94) are equalized, when the outdoor heat exchanger (23) into which the refrigerant is introduced functions as a condenser or an evaporator, by providing the vertical partition plate (91) with the communication hole (99) which connects the first space (93) and the upper space (97) of the second space (94). This structure can prevent the deformation or other damage to the second header collecting pipe (70) and the distributing structure (90) without increasing the stiffness of the second header collecting pipe (70) and the distributing structure (90).

<<Other Aspects>>

In the first aspect, the distributing structure (90) is comprised of one vertical partition plate (91) and one division plate (92). However, the distributing structure (90) may be comprised of one vertical partition plate (91) alone, or may be comprised of one vertical partition plate (91) and a plurality of division plates (92).

In the first aspect, the through hole (91*a*) formed in the vertical partition plate (91) serves as a communication path which connects the first space (93) and the second space (94). However, the communication path is not limited to such a through hole (91*a*). A gap may be formed between the lower edge of the vertical partition plate (91) and the bottom surface of each of the principal communication spaces (75*a*-75*f*), and this gap may serve as a communication path.

In the first aspect, each of the principal communication spaces (75*a*-75*f*) is associated with one of the vertical partition plates (91), but the vertical partition plates (91) for the principal communication spaces (75*a*-75*f*) may be made of one plate-like member.

The outdoor heat exchanger (23) of each of the above embodiments may be provided with wavy fins instead of the plate-like fins (32). Such fins are corrugated fins, which have a vertically meandering shape. These wavy fins are arranged one by one between the flat tubes (31) vertically adjacent to each other.

In the above embodiments, an example in which the outdoor heat exchanger (23) has only one heat exchanger unit (30) has been described, but the outdoor heat exchanger (23) may have a plurality of heat exchanger units (30).

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims

INDUSTRIAL APPLICABILITY

As can be seen from the foregoing, the present invention is useful for a heat exchanger having flat tubes and fins for exchanging heat between a refrigerant and air.

DESCRIPTION OF REFERENCE CHARACTERS

10 Air Conditioner
20 Refrigerant Circuit

23 Outdoor Heat Exchanger
30 Heat Exchanger Unit
31 Flat Tube
32 Fin
40 First Header Collecting Pipe
70 Second Header Collecting Pipe
75*a*-75*f* First To Sixth Principal communication Spaces (Upstream Communication Spaces)
91 Vertical Partition Plate (Partition Plate)
91*a* Through Hole
92 Division Plate
93 First Space
94 Second Space

The invention claimed is:

1. A heat exchanger, comprising:
a plurality of flat tubes arranged one above the other;
a plurality of fins connected to the flat tubes; and
a header collecting pipe in which an end of each of the plurality of flat tubes is inserted, wherein
the heat exchanger exchanges heat between a fluid flowing through the flat tubes and air outside the flat tubes,
the header collecting pipe extends in a vertical direction,
the header collecting pipe comprises an upstream communication space that communicates with an upstream side of the plurality of flat tubes when the heat exchanger functions as an evaporator,
the heat exchanger further comprises a partition plate disposed in the upstream communication space,
the partition plate extends in the vertical direction and divides the upstream communication space into a first space in communication with the plurality of flat tubes and a second space in communication with an inlet portion that introduces a refrigerant into the upstream communication space when the heat exchanger functions as an evaporator,
a communication path, formed at a lower portion of the upstream communication space, through which the first space and the second space communicate,
the inlet portion introduces a gas-liquid two-phase refrigerant into the upstream communication space, and
the gas-liquid two-phase refrigerant flows into the first space only through the communication path.

2. The heat exchanger of claim 1, wherein
the communication path is located below the lowermost of the flat tubes that are in communication with the upstream communication space.

3. The heat exchanger of claim 1, wherein
the communication path is a through hole formed in a lower portion of the partition plate.

4. An air conditioner, comprising:
a refrigerant circuit comprising the heat exchanger of claim 1, wherein
a refrigerant is circulated in the refrigerant circuit.

5. The heat exchanger of claim 2, wherein
the communication path is a through hole formed in a lower portion of the partition plate.

6. The heat exchanger of claim 2, further comprising:
a division plate, disposed at the lower portion of the upstream communication space above the inlet portion and the communication path, that divides the second space into an upper space and a lower space.

7. The heat exchanger of claim 3, further comprising:
a division plate, disposed at the lower portion of the upstream communication space above the inlet portion and the communication path, that divides the second space into an upper space and a lower space.

8. The heat exchanger of claim 5, further comprising:
a division plate, disposed at the lower portion of the upstream communication space above the inlet portion and the communication path, that divides the second space into an upper space and a lower space.

9. The heat exchanger of claim 6, wherein
the partition plate comprises a communication hole through which the upper space of the second space and the first space communicate.

10. The heat exchanger of claim 7, wherein
the partition plate comprises a communication hole through which the upper space of the second space and the first space communicate.

11. The heat exchanger of claim 8, wherein
the partition plate comprises a communication hole through which the upper space of the second space and the first space communicate.

12. A heat exchanger, comprising:
a plurality of flat tubes arranged one above the other;
a plurality of fins connected to the flat tubes; and
a header collecting pipe in which an end of each of the plurality of flat tubes is inserted, wherein
the heat exchanger exchanges heat between a fluid flowing through the flat tubes and air outside the flat tubes,
the header collecting pipe extends in a vertical direction,
the header collecting pipe comprises an upstream communication space that communicates with an upstream side of the plurality of flat tubes when the heat exchanger functions as an evaporator,
the heat exchanger further comprises a partition plate disposed in the upstream communication space,
the partition plate extends in the vertical direction through an entirety of the upstream communication space and divides the upstream communication space into a first space in communication with the plurality of flat tubes and a second space in communication with an inlet portion that introduces a refrigerant into the upstream communication space when the heat exchanger functions as an evaporator,
a communication path, formed at a lower portion of the upstream communication space, through which the first space and the second space communicate, and
a division plate, disposed at the lower portion of the upstream communication space above the inlet portion and the communication path, that divides the second space into an upper space and a lower space.

13. The heat exchanger of claim 12, wherein
the partition plate comprises a communication hole through which the upper space of the second space and the first space communicate.

14. The heat exchanger of claim 12, wherein
the communication path is located below the lowermost of the flat tubes that are in communication with the upstream communication space.

15. The heat exchanger of claim 12, wherein
the communication path is a through hole formed in a lower portion of the partition plate.

16. The heat exchanger of claim 14, wherein
the communication path is a through hole formed in a lower portion of the partition plate.

17. The heat exchanger of claim 14, wherein
the partition plate comprises a communication hole through which the upper space of the second space and the first space to communicate.

18. The heat exchanger of claim 15, wherein
the partition plate comprises a communication hole through which the upper space of the second space and the first space to communicate.

19. The heat exchanger of claim 16, wherein the partition plate comprises a communication hole through which the upper space of the second space and the first space to communicate.

20. An air conditioner, comprising:

a refrigerant circuit comprising the heat exchanger of claim 12, wherein a refrigerant is circulated in the refrigerant circuit.

* * * * *